US005363131A

United States Patent [19]

Momose et al.

[11] Patent Number: 5,363,131

[45] Date of Patent: Nov. 8, 1994

[54] INK JET RECORDING HEAD

[75] Inventors: Kaoru Momose; Tsutomu Nishiwaki; Masanori Tanizaki; Hajime Mizutani, all of Nagano, Japan

[73] Assignee: Seiko Epson Corporation, Tokyo, Japan

[21] Appl. No.: 770,814

[22] Filed: Oct. 4, 1991

[30] Foreign Application Priority Data

| | | | |
|---|---|---|---|
| Oct. 5, 1990 | [JP] | Japan | 2-267624 |
| Oct. 26, 1990 | [JP] | Japan | 2-290418 |
| Nov. 2, 1990 | [JP] | Japan | 2-297680 |
| Nov. 16, 1990 | [JP] | Japan | 2-310514 |
| Nov. 20, 1990 | [JP] | Japan | 2-315467 |
| Sep. 25, 1991 | [JP] | Japan | 3-273428 |

[51] Int. Cl.[5] ..... B41J 2/045

[52] U.S. Cl. ..... 347/46; 347/68

[58] Field of Search ..... 346/140 R, 75; 310/328, 310/330, 365, 366, 323; B41J 2/045

[56] References Cited

U.S. PATENT DOCUMENTS

| | | | |
|---|---|---|---|
| 3,946,398 | 3/1976 | Kyser et al. | 346/1.1 |
| 4,216,477 | 8/1980 | Matsuda et al. | 346/140 R |
| 4,308,547 | 12/1981 | Lovelady et al. | 346/140 R |
| 4,523,121 | 6/1985 | Takahashi et al. | 310/334 |
| 4,752,788 | 6/1988 | Yasuhara et al. | 346/140 R |
| 4,812,698 | 3/1989 | Chida et al. | 310/366 |
| 4,825,227 | 4/1989 | Fischbeck et al. | 346/1.1 |
| 5,063,396 | 11/1991 | Shiokawa et al. | 346/140 R |

FOREIGN PATENT DOCUMENTS

| | | | |
|---|---|---|---|
| 0167470 | 12/1981 | Japan | 346/75 |

OTHER PUBLICATIONS

Patent Abstracts of Japan, vol. 4, No. 111, JP-A-55 069 473 (Ricoh K.K.) May 26, 1980.

Patent Abstracts of Japan, vol. 5, No. 33, JP-A-55 158 979 (Suwa Seikosha K.K.) Dec. 10, 1980.

*Primary Examiner*—Benjamin R. Fuller

*Assistant Examiner*—Alrick Bobb

*Attorney, Agent, or Firm*—Sughrue, Mion, Zinn, Macpeak & Seas

[57] ABSTRACT

An ink jet recording head, in which a vibrating element includes electrodes disposed on both surfaces of at least one of its edge portions at a dot forming pitch. A gap forming member is disposed so as to form a gap suitable for producing ink mist on a surface confronting a vibrating surface of the vibrating element. Since the ink is retained in this gap by surface tension, upon application of an alternate voltage to the vibrating element to produce an edge-mode vibration, the vibration produced at a piezoelectric body substrate is transmitted to the ink, propagating through the ink. The vibration propagated up to an interface between the ink and the air is transformed into a surface wave, thereby misting the ink.

The thus produced ink mist, having vibrational kinetic energy, splashes in the air and thus forms a dot on a recording sheet. Since the amount of ink adhering to the recording sheet is proportional to an ink mist producing time, the optical density of a dot can be adjusted by controlling the alternate voltage application time.

43 Claims, 30 Drawing Sheets

| RECORDING TIME | DOT OBSERVED BY MICROPHOTOGRAPHY |
|---|---|
| 100 μ sec |  |
| 200 μ sec |  |
| 300 μ sec |  |
| 400 μ sec |  |
| 500 μ sec |  |

FIG. 12

| REGION | JETTING MODE | DOT PROFILE |
|---|---|---|
| A | | |
| B | | |
| C | | |
| D | | |

INK JET RECORDING HEAD

BACKGROUND OF THE INVENTION

This invention relates to an ink jet recording head that records dots on a recording medium by splashing ink in the form of droplets, utilizing mechanical energy produced by a piezoelectric element.

One typical example of an ink jet head that makes a recording by jetting ink is, as disclosed in U.S. Pat. No. 3,946,398, constructed so that the ink is attracted by changing the volume of an ink chamber while vibrating a piezoelectric element at a first timing, and splashed onto a recording sheet in the form of droplets by applying a pressure at a second timing. As proposed in Japanese Patent Unexamined Publication No. 161935/1979, another example has such a construction that a heating element is contained in an extremely small nozzle-forming member; that bubbles are instantaneously produced in such nozzle-forming member by heat energy derived from the heating element; and that ink is jetted out by the expanding force of bubbles.

The recording heads utilizing the principle of a pump produce the minimum size of an ink droplet which is in the order of 100 to 200 μm, thereby implementing a recording density of 150 to 300 DPI. Although this can ensure practically applicable high-quality recording of binary data such as character data, data including different levels of dot data such as photographs and pictures cannot be reproduced on a dot basis. For this reason, it is required that a single pixel, which is a unit of image data, consist of a plurality of dots and that a density level be expressed by increasing or decreasing the number of dots. And this further requires that an area for a plurality of dots be provided to print a single pixel and that the document image data be sampled at an appropriate density to form the print data. Thus, the number of pixels in the printed document becomes smaller than that in the document image, thereby reducing the resolution.

To overcome this problem, it has been proposed to provide a recording head such that a supersonic vibrating element having an acoustic lens is immersed in ink and that ink droplets are jetted by a supersonic beam converged at a single point (Japanese Patent Unexamined Publication No. 166547/1988). According to this concept, the amount of ink to be applied to a recording sheet is proportional to the operating time of the supersonic vibrating element. Thus, the optical density of a dot can be adjusted freely by controlling the operating time and this allows image data to be recorded without reducing their recording density.

However, since the vibrational energy utilization efficiency is low in such a system, it requires a large supersonic vibrating element, which not only makes the recording head larger in structure, but also imposes a restriction in the installing direction of the recording head from the requirement that the surface of the ink be exposed.

To overcome these problems, the applicant of the invention has provided a nozzleless ink jet recording head as disclosed in U.S. Ser. No. 492,446, U.S. Pat. No. 5,063,396, issued Nov. 5, 1991. This nozzleless ink jet recording head includes: a propagating body that has a propagating surface for propagating a surface elastic wave to an edge portion that is supplied with the ink; and means for producing the surface elastic wave to this propagating body. This head can provide a sufficient splashing force irrespective of the size of ink particles, thereby not only controlling the size of a printable dot, but also contributing to simplifying the structure and improving the durability by eliminating the ink pressure chamber. But at the same time, a propagating path suitable for producing a surface wave is required since the head utilizes the surface elastic wave, and this demands not only a vibrating substrate of a proper size, but also a high level of drive frequency and complicated signal processing circuits.

SUMMARY OF THE INVENTION

An object of the invention is to provide a downsizable, novel nozzleless ink jet recording head. Such a nozzleless ink jet recording head includes a pair of confronting electrodes on both surfaces of a piezoelectric body substrate at an edge portion thereof and a member for forming a gap suitable for producing ink mist on one of the surfaces of the piezoelectric body substrate. The piezoelectric body substrate is caused to vibrate in an edge mode with the ink retained in the gap, thereby producing ink mist and causing the produced mist to splash outside. Since the amount of ink mist is proportional to the time during which a drive voltage is applied, the adjustment of the drive voltage application time allows the density of a dot to be adjusted. In addition, the recording head can be operated with a relatively low drive frequency.

BRIEF DESCRIPTION OF THE DRAWINGS

FIG. 12 is a schematic showing the mode of producing the ink mist in the ink jet recording head in relation to the length of a gap for jetting ink mist;

FIGS. 34, 35, 36, and FIGS. 37 (*a*), (*b*) are diagrams respectively showing exemplary members for supplying ink to an ink mist producing region, of which FIG. 34 shows a type such that ink is supplied while retaining the ink in porous bodies, while FIGS. 35, 36, 37 (*a*), (*b*) show types such that ink is supplied while utilizing vibration of a piezoelectric body substrate;

DETAILED DESCRIPTION OF THE PREFERRED EMBODIMENTS

The invention will hereunder be described in detail with reference to embodiments shown in the accompanying drawings.

Figure 1:
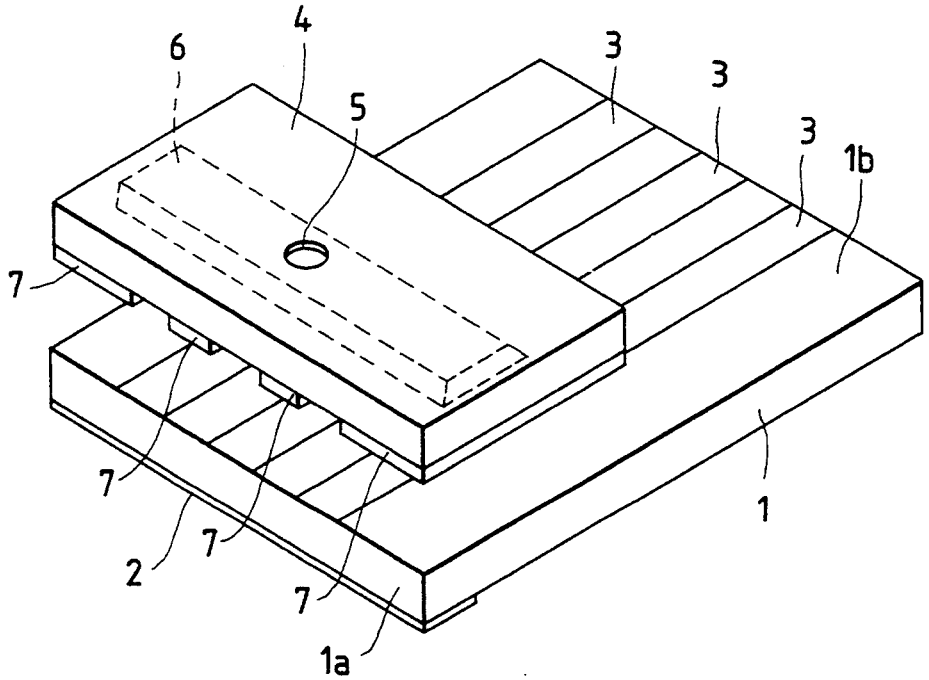
FIG. 1 is an exploded assembly diagram showing an ink jet recording head, which is a first embodiment of the invention.
Figure 2:
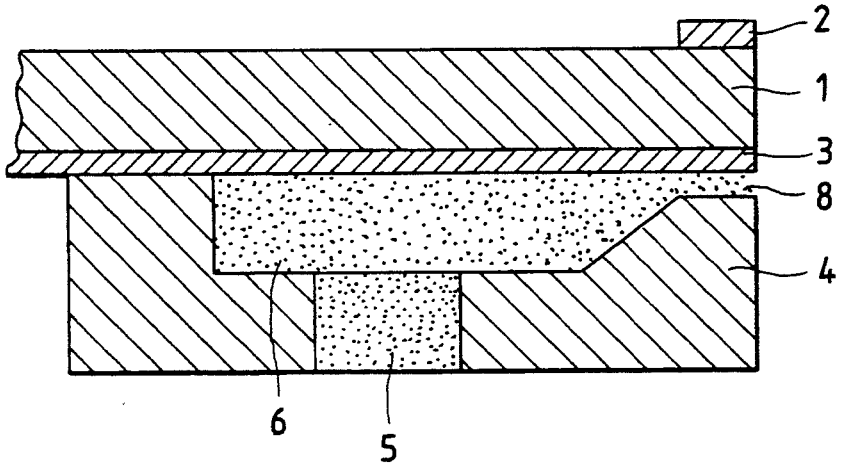
FIG. 2 is a diagram showing a sectional structure of the ink jet recording head shown in FIG. 1, with the device shown inverted.

FIGS. 1 and 2 show an ink jet recording head, which is a first embodiment of the invention. In FIGS. 1 and 2, reference numeral 1 designates a piezoelectric body substrate, which is prepared by molding a PZT ceramic ("Nepeck N21" manufactured by Tokin) into a thickness of 600 μm and polarizing it thicknesswise so that it can vibrate in an edge mode. The edge-mode vibration is a state of vibration in which vibrational energy concentrates at end portions of a piezoelectric plate, and exhibits the feature that a higher degree of kinetic energy can be given to a substance that is in contact with the end portions with a small amount of drive energy.

Close to an end of one of the surfaces of the piezoelectric body substrate 1, i.e., the outer surface when it is assembled into a recording head, is a common electrode 2 arranged by forming an electroconductive film that extends in parallel to an end surface 1*a*.

On the other surface 1*b* of the piezoelectric body substrate 1 that will come in contact with ink when assembled into the recording head are a plurality of segment electrodes 3, which are arranged equidistantly in a direction parallel to the direction of jetting the ink, i.e., in a direction orthogonal to the common electrode 2. These electrodes 2, 3 are prepared by sputtering two metal layers, one made of NiCr and the other made of Au, and then forming them into predetermined dimensions by, e.g., photolithography. The width of each segment electrode 3 and common electrode 2 is 150 μm, and the segment electrodes 3 are arrayed at an interval of about 254 μm.

Reference numeral 4 designates an ink supply member. On a side confronting the piezoelectric body substrate when the ink supply member 4 is assembled into the piezoelectric body substrate 1 as a recording head is an ink tank 6 that serves to supply the ink from an ink supply inlet 5 to the segment electrodes 3, uniformly. The ink supply member 4 is also secured to the piezoelectric body substrate 1 so that ink mist jetting outlets 8 are formed at a portion confronting the end surface 1*a* of the piezoelectric body substrate 1 through spacers 7 that are disposed between the electrodes. Each ink mist jetting outlet 8 is formed so that a distance of about 5 to 30 μm is kept with respect to the corresponding segment electrode 3.

Each spacer 7 is formed by sputtering an aluminum film of about 10 μm in thickness on a surface of a glass substrate of about 1 mm in thickness and then etching the aluminum thin film into a predetermined profile by photolithography, or formed by coating microbead which has a diameter similar to that of the gap to be formed and which is mixed with an adhesive.

In this embodiment, with the ink in the ink tank 6 being supplied by surface tension to the ink mist jetting outlets 8 formed by the ink supply member 4 and the spacers 7, the common electrode 2 is grounded and a segment electrode in a region to which the ink is jetted is selected, and an alternate voltage whose frequency is about 2 to 7 MHZ is applied across the electrodes 2, 3. An alternate electric field acts only on a small region of the piezoelectric body substrate 1 interposed between the selected segment electrode 3 and the common electrode 2 to which a drive signal have been applied. As a result, the region of the piezoelectric body substrate 1 on which the electric field acts, i.e., only its edge portion, vibrates in synchronism with the frequency of the drive signal.

The thus initiated vibration is such that its energy concentrates on an end portion at which the common electrode 2 of the piezoelectric body substrate 1 is formed; i.e., a so-called thickness edge-mode vibration produced by applying a predetermined drive signal frequency that is determined by the thickness of the piezoelectric body substrate 1 and a frequency coefficient for a thickness edge mode. The vibrational energy is transmitted to the ink that has been introduced to the ink mist jetting outlet 8 from the ink supply member by capillary action. The vibration propagated to the ink is then converted into a surface wave at the interface with the air. When the energy of the surface wave takes a value larger than a predetermined level, the ink is separated into a small particles, misted and splashed a distance of about several millimeters in a predetermined direction, eventually forming a dot by adhering to a recording sheet arranged in front of the jetting outlet.

Figure 3:
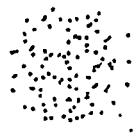
FIG. 3 is a diagram showing the relationship between the time for which to apply a signal to a piezoelectric body substrate using the ink jet recording head of the invention and the density of dots formed on a recording sheet thereby.
Figure 3:
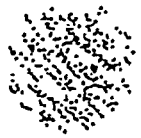
Figure 3:
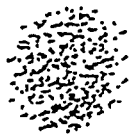
Figure 3:
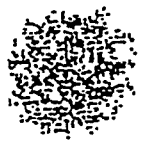
Figure 3:
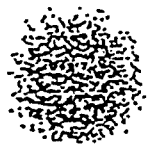

FIG. 3 shows dots formed by changing the time for which a drive voltage is applied on a 100-microsecond basis between 100 and 500 microseconds using the head in the form of microphotography. The diffusion area of the ink mist is constant and its integrated amount is proportional to the time. Thus, it is understood that only the density of the dot is increased in proportion to the application time without changing the area.

Figure 4:
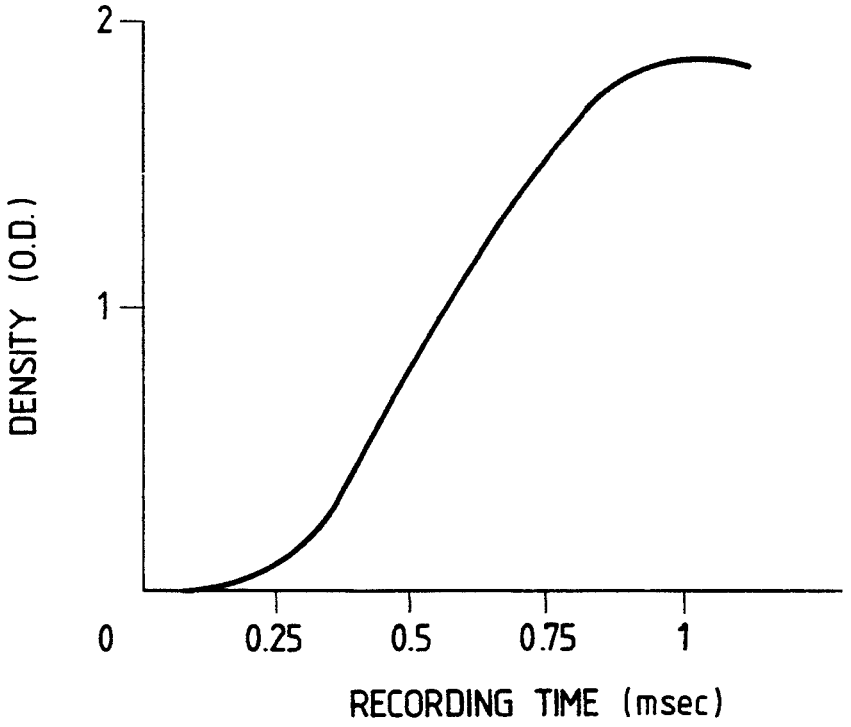
FIG. 4 is a plot showing the time for which to apply a drive signal to the ink jet recording head of the invention in relation of the optical density of dots formed thereby.

FIG. 4 plots measurements of the optical density of a dot formed by extending the voltage application time to 1 millisecond. It is found from these measurements that the optical density can be varied by the voltage application time without changing the dot forming area over such a wide density range from about 0.1 to 1.8.

Since it is possible to divide such optical density range into 256 levels, the optical density of a dot can be changed minutely with such a simple operation as adjusting the drive voltage application time without changing the dot forming area. Therefore, a faithful recording of data including the tone data such as image data can be implemented without reducing the resolution.

Changes in the amount of jetted ink were analyzed under the following conditions. The sample used is a 600 μm-thick PZT ceramics (Nepeck N21 manufactured by Tokin) having such a vibrational characteristic as shown in Table 1. The PZT ceramics was similarly subjected to a polarization process in the direction of thickness and had the common electrode 2 and the segment electrodes 3 formed. A bias voltage Vb of 200 V is applied to the thus prepared sample, or the piezoelectric body substrate 1, in the direction of polarization so that the polarization is not inverted. Effective power to be supplied between the common electrode 2 and segment electrodes 3 of the piezoelectric vibrating body 1 was maintained at a constant value, only changing the frequency thereof.

TABLE 1

| Vibration mode | Frequency constant (Hz - m) |
|---|---|
| N1 (radial) | 1960 |
| N2 (length) | 1410 |
| N3 (longitudinal) | 1310 |
| N4 (thickness) | 1940 |
| N5 (thickness edge) | 1350 |

Figure 5:
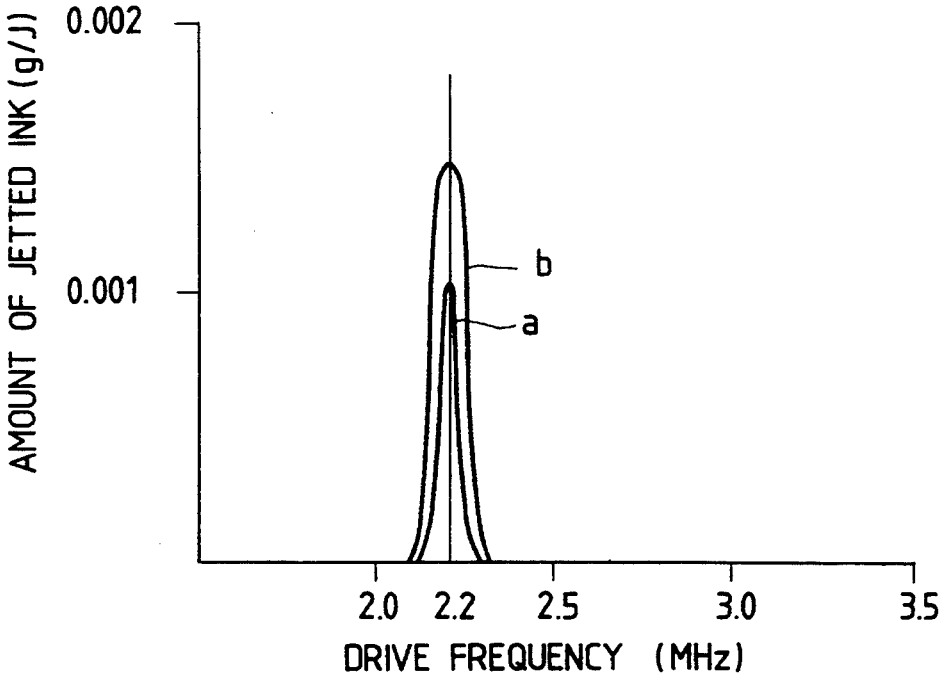
FIG. 5 is a plot showing the amount of jetted ink per unit time as a function of the frequency in the case where a sinusoidal wave and a rectangular wave are used as drive signals.
Figure 6:
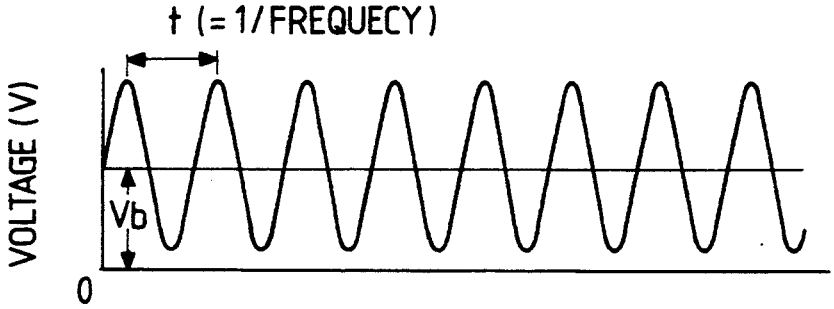
FIGS. 6 and 7 are diagrams respectively showing exemplary drive signals to be used in the invention.
Figure 7:
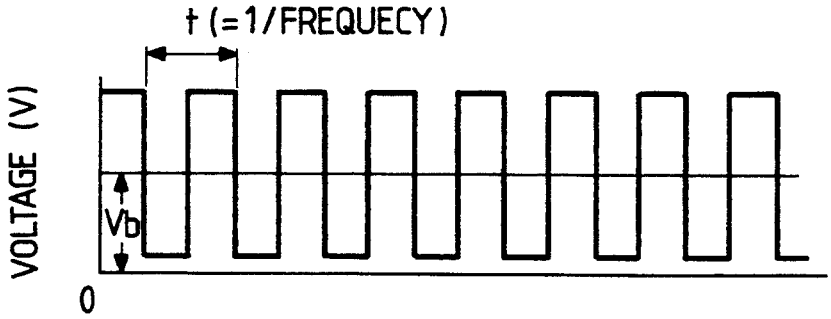

FIG. 5 shows the results of the analysis. In FIG. 5, a curve designated by reference character a indicates a characteristic in the case where a sinusoidally varying D.C. voltage wave such as shown in FIG. 6 was used, while a curve designated by reference character b indicates a characteristic in the case where a rectangular wave D.C. voltage such as shown in FIG. 7 was used. As is apparent from these characteristic curves, it is only possible to jet the ink at a drive voltage frequency of 2.2 MHz±5% in both cases, with a higher jetting efficiency observed with the rectangular wave.

Figure 8:
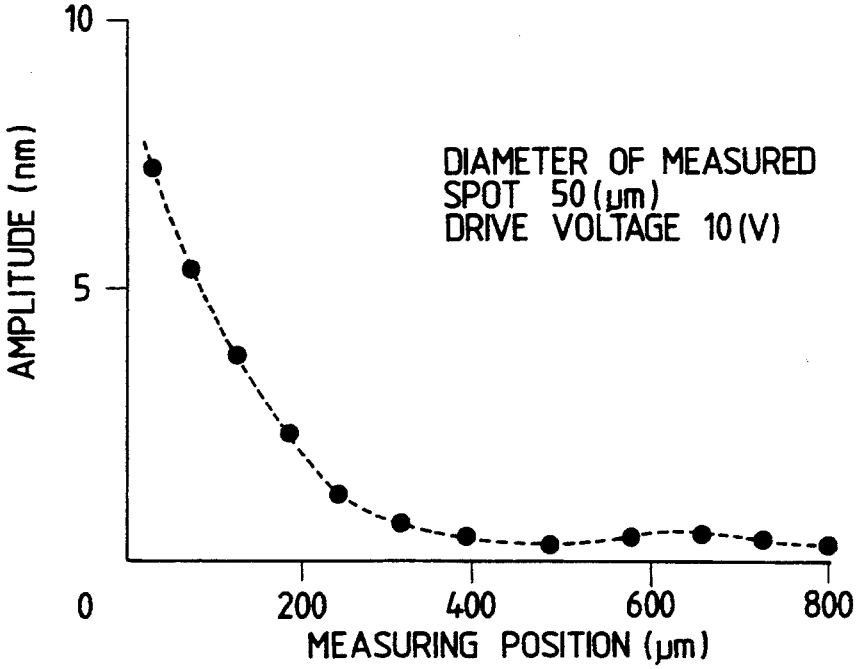
FIG. 8 is a plot showing the vibrating displacement at an end portion of a piezoelectric body substrate in the direction of thickness.
Figure 9:
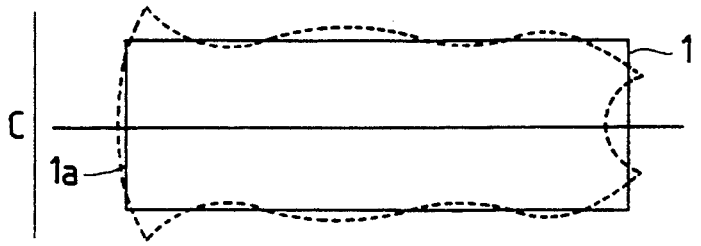
FIG. 9 is a schematic showing the displacement by an edge-mode vibration initiated on a piezoelectric body substrate to be used in the invention.

The frequency coefficient in the case of jetting the ink is 1300 Hz−m when calculated from the thickness of the piezoelectric body substrate and the resonance frequency based on the results of the above analysis. Thus, it can be said that the mode of vibration produced by the sample is either the longitudinal mode or the thickness edge mode, referencing the frequency constants classified by the vibrating mode in Table 1. To further verify that the vibration produced by the sample is one of the aforesaid two modes, the maximum displacement observed on a segment electrode when a 600 μm-thick piezoelectric body substrate was driven at a frequency of 2.2 MHz was measured using a displacement gauge (Optical Probe manufactured by BMI). The obtained results are as shown in FIG. 8. That is, the horizontal axis in FIG. 8 expresses the distance toward the segment electrode 3 on a μm basis with the end portion of the piezoelectric body substrate having the common electrode 2 as its origin, while the vertical axis expresses the amount of displacement at the small region at respective positions. As is apparent from this figure, the amplitude in the thickness direction becomes maximum at the edge portion, while the displacement at the center of the piezoelectric body substrate is significantly reduced. Hence, it can be judged that the piezoelectric body substrate vibrates in the thickness edge mode, in which, as shown in FIG. 9, the edge portion 1*a* vibrates with the maximum amplitude that is symmetrical about the centerline C—C, the edge portion 1*a* being in a region where the electrodes are formed.

This relationship can be expressed as follows using an equation (1), where f (Hz) is the frequency of a drive signal with which the ink jetting efficiency is optimized; N (Hz—m) is the frequency constant of the thickness edge mode of a piezoelectric body substrate; and t (m) is the thickness of the piezoelectric body substrate.

$$f=N/t \quad (1)$$

Figure 10:
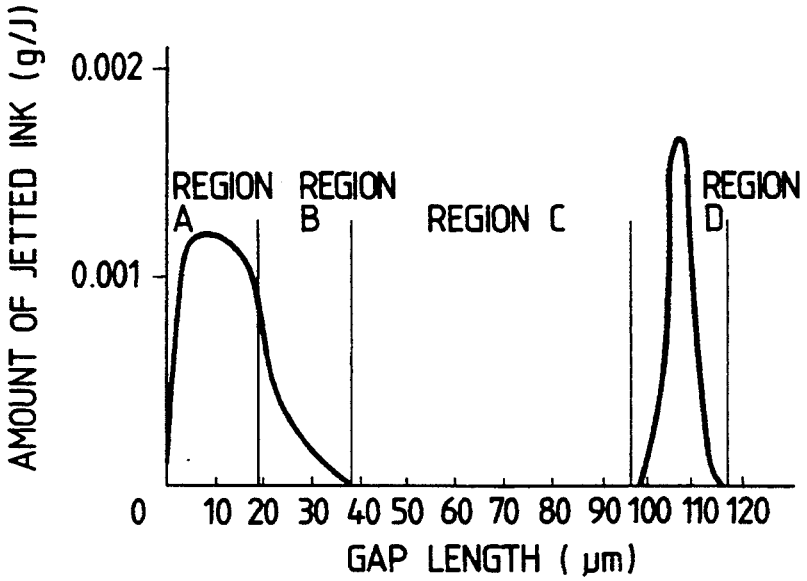
FIG. 10 is a plot showing the length of a gap for jetting ink mist in relation to the amount of jetted ink per unit energy.
Figure 11:
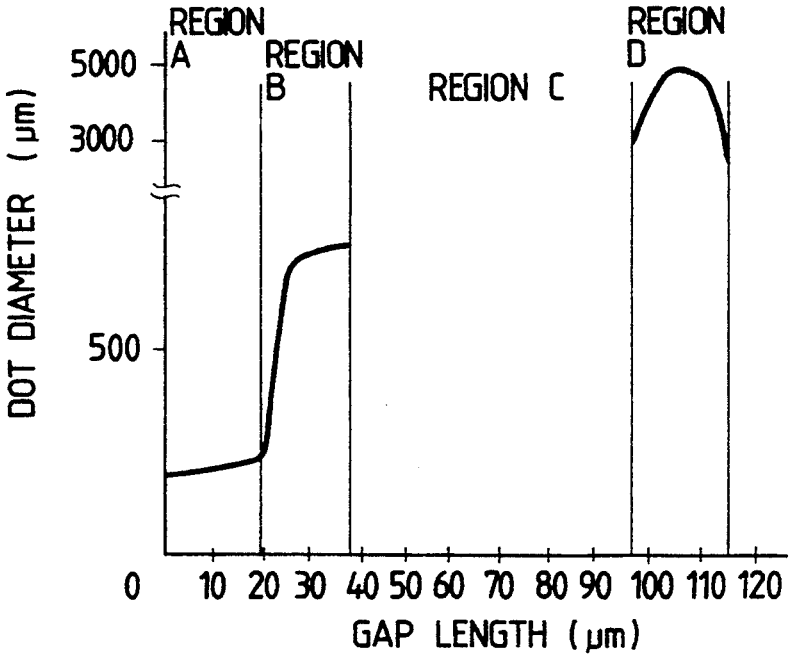
FIG. 11 is a plot showing the length of a gap for jetting ink mist of the ink jet recording head of the invention in relation to the size of dots formed on a recording sheet.

The above results were obtained by setting the optimal gap for producing the ink mist to a value on a trial-and-error basis. To clarify the relationship between the ink mist producing mode and the gap, the relationship between the amount of produced ink mist while changing the gap length and the diffusion of the ink mist, i.e., the diameter of a dot formed on a recording sheet was analyzed. The obtained results were as shown in FIGS. 10 and 11.

That is, as the gap length is gradually increased from 0, it is at 5 μm that the ink mist was first produced, with the ink mist being continuously produced stably up to a gap length of about 20 μm (the gap length ranging from 5 to 20 μm is hereinafter referred to as "region A"). With the gap length exceeding 20 μm, production of the ink mist was drastically reduced, while the ink mist is no longer produced at about 40 μm (the gap length raging from 20 to 40 μm is hereinafter referred to as "region B"). Then, no ink mist was produced up to a gap length of 100 μm (the gap length ranging from 40 to 100 μm is hereinafter referred to as "region C"), and with gap lengths exceeding 100 μm, the production of the ink mist was resumed, exhibiting a noticeable increase in the amount of produced ink mist. The peak was observed at about 105 μm, and at about 115 μm the production was stopped (the gap length ranging from 110 to 115 μm is hereinafter referred to as "region D").

The relationship between the gap length and the diameter of a dot formed on a recording sheet was analyzed. In the region A, the diameter of the dot formed on the recording sheet was about 200 μm with the size of the ink particles forming the mist being uniform. In the region B, the diameter of the dot formed on the recording sheet exceeded 500 μm and the size of the individual ink particles became extremely inconsistent. In the region D, not only the diameter of the dot formed on the recording sheet became so large as 3000 to 5000 μm, but also the size of the individual ink particles increased, producing spots which make its optical density locally nonuniform.

FIG. 12 schematically shows these phenomena. In the region A, the ink particles are produced at the ink mist jetting outlet in a predetermined direction, converged while maintaining this direction, and splashed onto a recording sheet. In the region B, the ink particles are produced at the ink mist jetting outlet in a diverging direction and splashed while maintaining the diverging direction. In this case, some ink portions that are not sufficiently misted, i.e., ink droplets, are additionally produced, this making the diameter of the individual ink particles inconsistent. In the region C, the ink at the ink mist jetting outlet is not misted although it is being vibrated.

In the region D, the ink, while behaving as it does in the region C, is misted, producing some insufficiently misted particles, or ink droplets. With the area of the outlet opening being increased, the ink droplets are splashed while diverging at a large angle.

To conclude the foregoing description from the viewpoint of printing quality, it can be said that the aforesaid piezoelectric body substrate produces optimal ink mist when the gap length of the ink mist jetting outlet is in the range of 5 to 20 μm, because with such gap length, the individual ink particles forming the ink mist have a consistent size and are splashed in a predetermined direction, allowing a small dot to be formed.

As already described, the piezoelectric body substrate used in the above analyses was 600 μm in thickness. Similar analyses were made using a 200 μm-thick PZT ceramic piezoelectric body substrate. This piezoelectric body substrate initiated an edge-mode vibration at 6.6 MHz. The modes of the ink mist similarly produced by changing the gap length of the ink mist jetting outlet were studied.

The obtained results indicate that a phenomenon similar to that in the region A was observed when the gap length of the ink mist jetting outlet was 7 μm or less; that the phenomenon in the region B was observed when the gap length ranged from 7 to 13 μm; and that the phenomenon in the region C was observed when the gap length ranged from 34 to 40 μm. That is, the same phenomena were observed with the gap length of the ink mist Jetting outlet which was reduced by $\frac{1}{3}$, in proportion to the $\frac{1}{3}$ reduction in the thickness of the piezoelectric body substrate.

Such a phenomenon will be further analyzed in relation to the wavelength of a vibration propagated to ink. Since aqueous ink is used in this analysis, the wavelength of a vibration produced in the ink present in the gap was 680 μm when the 600 μm-thick piezoelectric body substrate was used, and 230 μm when the 200 μm-thick piezoelectric body substrate was used (assuming that the speed of sound in water is 1500 m/s). Thus, it can be concluded that the phenomenon in the region A, i.e., the phenomenon that the ink mist produced is converged, that the size of a dot formed is small, and in addition, that the size of the individual ink particles is small and consistent, occurs when the gap length of the edge portion of the piezoelectric body substrate is about 1/30 or less the wavelength of a vibration produced in the ink.

Figure 13:
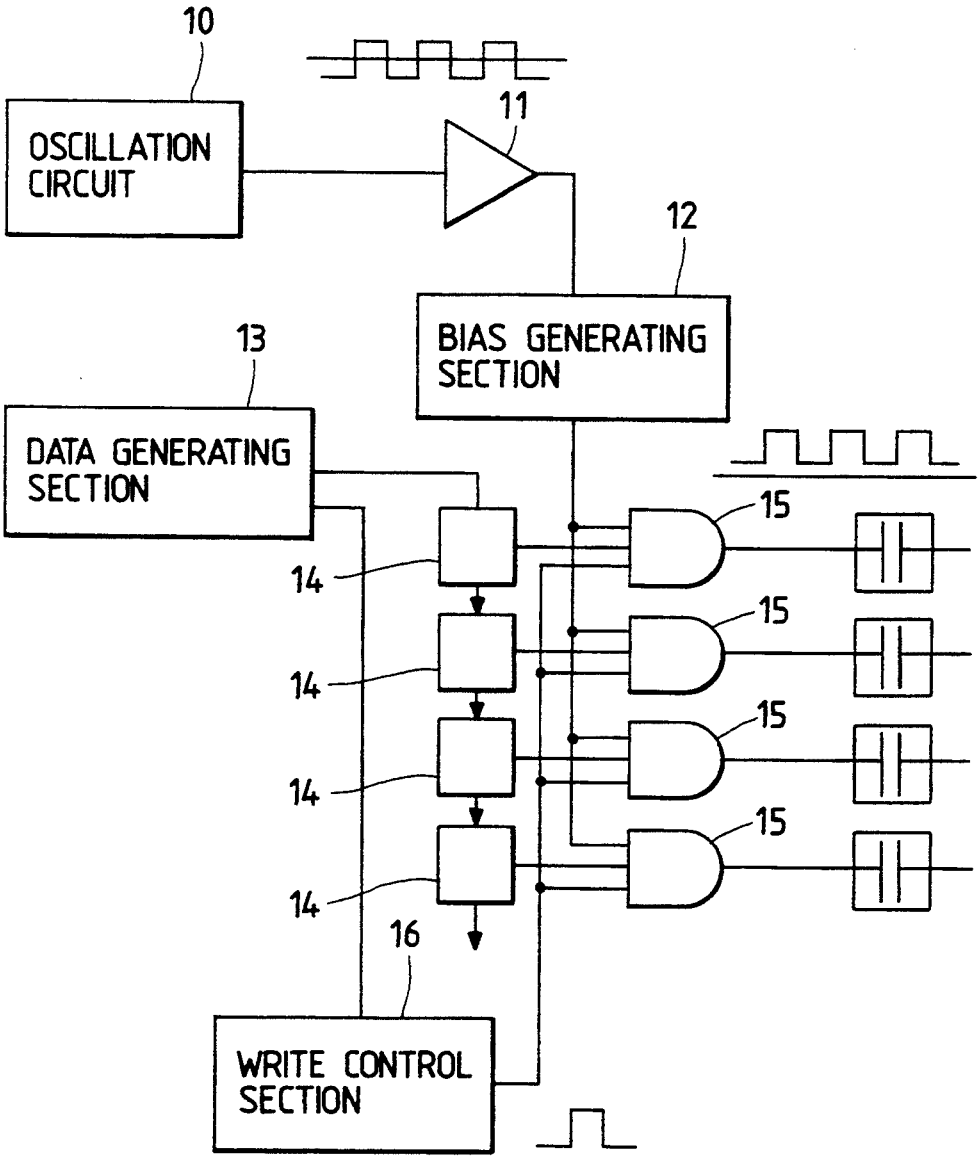
FIG. 13 is a block diagram showing an exemplary drive circuit to be used for driving the ink jet recording head of the invention.

FIG. 13 shows an exemplary drive circuit suitable for operating an ink jet recording head of the invention. The drive circuit is constructed as follows. A 2.2-MHz signal from an oscillation circuit 10 is amplified to a power level appropriate for producing ink mist by an amplifier 11 and is biased to a polarizing voltage by a bias generating section 12. On the other hand, signals generated by a data generating section 13 are sequentially stored by shift registers 14 in correspondence with the positions of the segment electrodes 3. These two types of signals are inputted to AND gate circuits 15 and outputted to the segment electrodes 3 in synchronism with the input timing of a timing signal from a write control section 16.

In this embodiment, when a signal from the data generating section 13 is first stored in the shift register 14 connected to a segment electrode with which to form a dot, and a print timing is then applied from the write control section 16, only the AND gate 15 that is connected to the segment electrode at the dot forming position is opened simultaneously therewith to thereby supply a drive signal to that segment electrode 3.

Figures 14A, 14B, 14C:
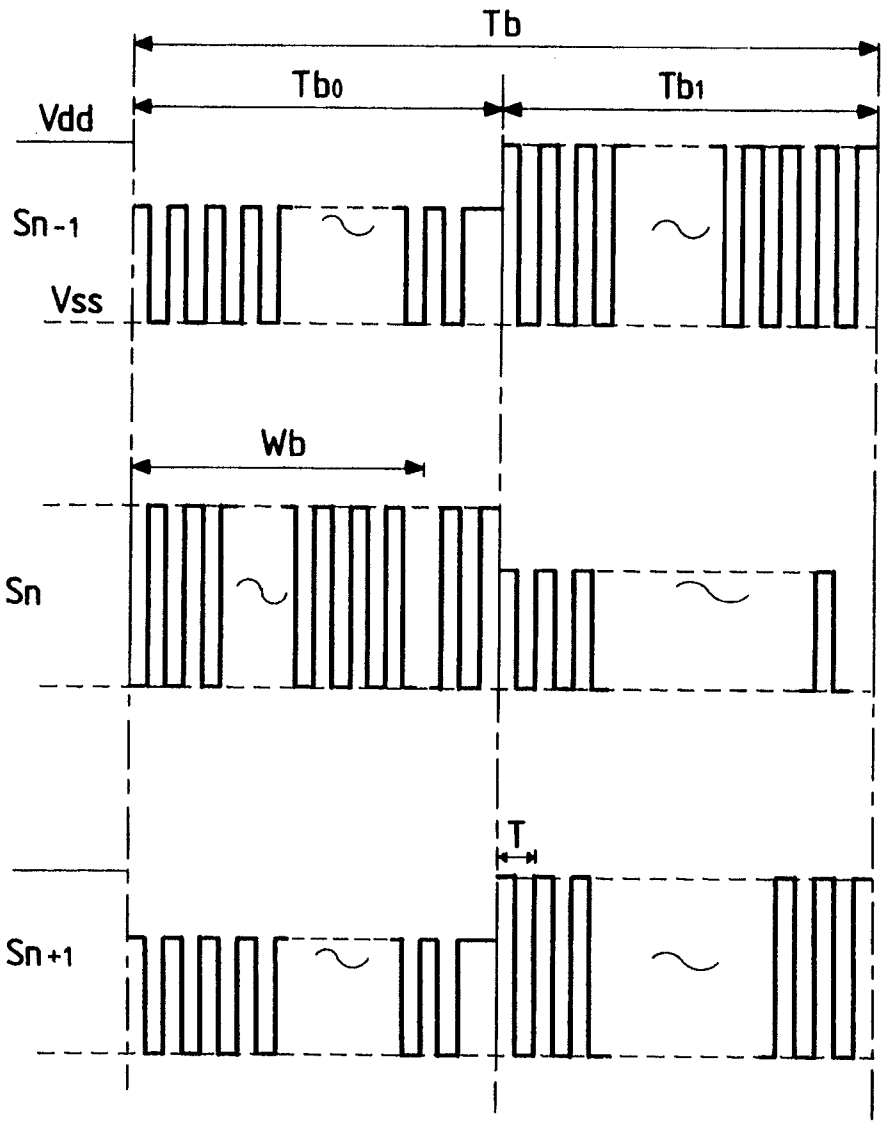
FIGS. 14 (*a*) to (*c*) are waveform charts respectively showing the phases of drive signals suitable for driving a recording head of the invention.

The drive signals are simultaneously applied to the respective segment electrodes at a plurality of dot forming regions in the above example. If the segment electrodes are arranged closer to one another to improve the resolution, then so-called crosstalk may, in some case, occur, the crosstalk being the phenomenon that a vibration is propagated between two adjacent segment electrodes and that dots are thereby formed on wrong positions. In such a case, as shown, in FIG. 14, the segment electrodes may be divided into two rows, odd and even, and printing is performed by doubling a single dot forming time interval to Tb, with the first half time interval Tb/2 being used by the odd row and the latter half time interval Tb/2 being used by the even row. That is, in the case where dots are formed by using the segment electrodes Sn−1, Sn+1 in the odd row, drive signals are applied to these segment electrodes, while applying a drive voltage to a segment electrode Sn in the even row, the drive voltage being 180°-out-of-phase with the drive signals applied to the segment electrodes Sn−1, Sn+1 in the odd row and being large enough to cancel crosstalk out. And in the case where a dot is formed using the segment electrode Sn in the even row, a drive signal is applied to the segment electrode Sn while applying drive voltages to the segment electrodes Sn−1, Sn+1 in the odd row, the drive voltages being 180°-out-of-phase with the drive signal applied to the segment electrode Sn and being large enough to cancel crosstalk out. As a result, undesired production of ink droplets due to leaking vibration from adjacent segment electrode regions can surely be prevented.

Figure 15:
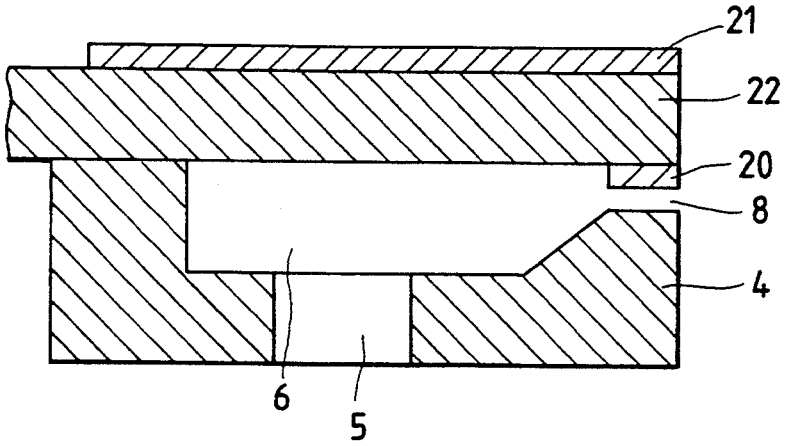
FIG. 15 is a sectional view of an ink jet recording head, which is a second embodiment of the invention.

While the segment electrodes 3 are arranged so as to come in contact with the ink in the above embodiment, it may be so arranged that the ink comes in contact with a common electrode 20 by inverting a piezoelectric body substrate 22 inside out as shown in FIG. 15 and that a segment electrode 21 becomes the upper surface, whereby not only the width of the piezoelectric body substrate 22 can be set to a value closer to the width of the ink supply member compared with the above embodiment, but also the interconnections between the segment electrodes and the drive signal circuit can be simplified.

Figure 16:
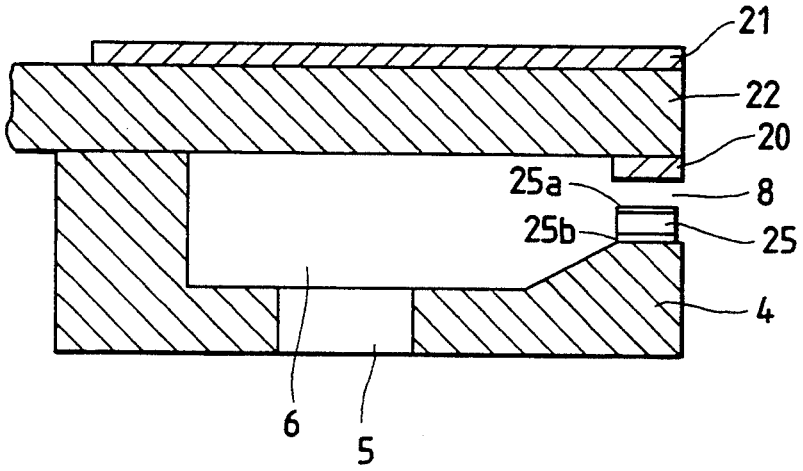
FIG. 16 is a sectional view of an ink jet recording head, which is a third embodiment of the invention.

FIG. 16 shows another embodiment of the invention. In FIG. 16, reference numeral 25 designates a piezoelectric body substrate that is disposed so as to confront an electrode 20 arranged on an ink mist jetting outlet 8, e.g., the common electrode 20, while interposing a gap therebetween. The substrate 25 is so long as to cover the entire ink mist forming region. On its surfaces are electrodes **25*a* and 25*b*** formed to exert electric field on itself for driving.

In this embodiment a drive signal is nominally applied across the electrodes **25*a*, 25*b* of the piezoelectric body substrate 25, the drive signal being at a level low enough to jet no ink mist, so that the entire part of the piezoelectric body substrate 25** is being vibrated, whereby a surface wave having energy obtained immediately before producing ink mist to the ink at the ink mist jetting outlet is generated. Upon application of a drive signal to a segment electrode with which to form a dot under this condition, the ink present in such segment electrode region is easily misted in response to the surface wave whose energy is extremely small.

Therefore, according to this embodiment, the energy required to mist the ink can be divided into two piezoelectric body substrates, thereby contributing to reducing the voltage level of a drive signal to be applied to a piezoelectric body substrate and thus allowing inexpensive, low voltage withstanding circuit parts to be used in the drive circuit. It is preferable that the signal to be applied to the piezoelectric body substrate 25 be a signal having such a frequency that the piezoelectric body substrate 25 initiates an edge-mode vibration.

Figure 17:
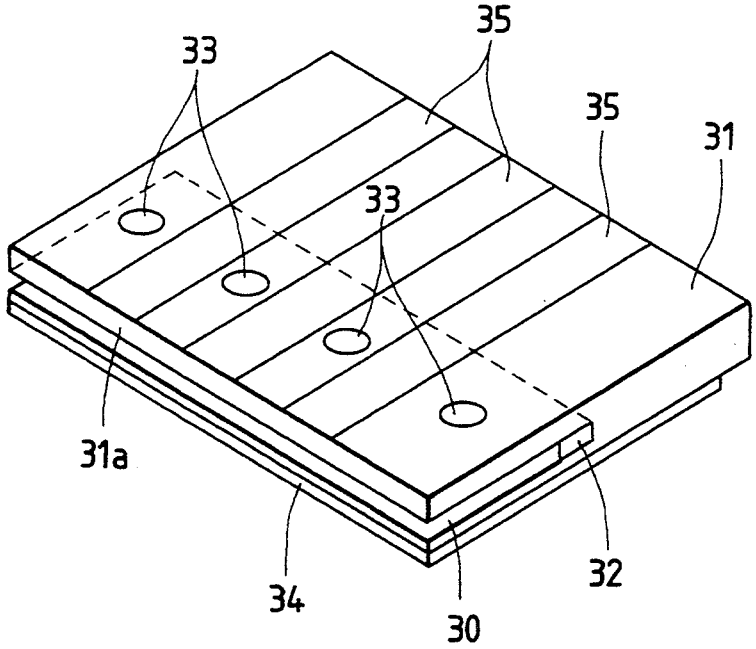
FIG. 17 is a perspective view of an ink jet recording head, which is a fourth embodiment of the invention.

FIG. 17 shows another exemplary ink mist jetting outlet. In FIG. 17, reference numeral 30 designates a slit that opens at one edge portion **31*a* of a piezoelectric body substrate 31. The slit 30 is about 10 μm wide and is subjected to a cutting process using a dicing saw so that it is deep enough to retain a sufficient amount of ink for misting, with a gap holding member 32 being inserted if necessary. The slit 30 communicates with ink supply inlets 33 bored on one of the surfaces of the piezoelectric body substrate 31, so that the ink can be supplied therefrom. A common electrode 34 is formed on the other surface of the piezoelectric body substrate 31 so as to interpose the slit 30, while segment electrodes 35 are formed so as to intersect the common electrode 34 while interposing the substrate 31** therebetween.

In this embodiment, upon application of a drive signal across the common electrode 34 and the segment electrode 35, an edge-mode vibration is produced in the vicinity of the bottom portion of the slit 30. As a result, the ink at the opening of the slit 30 is misted while receiving a surface wave similar to the one described before.

According to this embodiment, the aforesaid ink holding member can be dispensed with, allowing the entire head to be made very thin. As a result, recording with a higher degree of density can be possible by laminating the dot forming regions of the respective piezoelectric body substrates while shifting by a predetermined pitch. In addition, the recording head can be down-sized.

Figure 18:
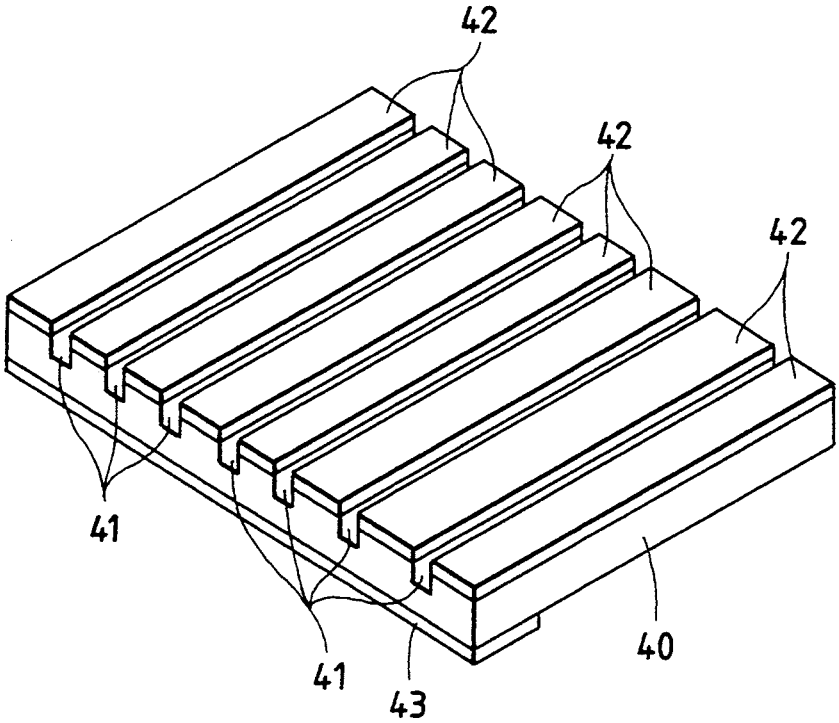
FIG. 18 is a perspective view of an ink jet recording head, which is a fifth embodiment of the invention.

While the respective segment electrodes in the above embodiment is formed so as to be independent of one another by sputtering or photolithography, it may be so formed that as shown in FIG. 18, an electroconductive layer is formed on one entire surface of a piezoelectric body substrate 40 by sputtering and is separated by grooves 41 so as to arrange segment electrodes 42. The grooves are formed using a dicing saw at such a pitch as to allow each projection to function as a segment electrode, each groove having a depth half the thickness of the piezoelectric body substrate 40 and extending to both edge portions thereof. A common electrode 43 is formed on one end of the thus prepared piezoelectric body substrate and an ink mist jetting outlet is formed on the common electrode 43 side. By supplying the ink to the ink mist jetting outlet, a recording head is completed.

According to this embodiment, each of the segment electrodes 42 are separated by the grooves 41 so that propagation of a vibration produced at adjacent segment electrodes can be damped by the grooves. Thus, this not only allows the segment electrodes to be arrayed at a smaller pitch so that a recording head with a higher degree of density can be obtained, but also enables restriction of each vibrating region to be released by each groove 41 so that an adequate amount of ink mist can be produced even at a voltage that is lower compared with that applied when the segment electrodes are formed by patterning. In addition, interference in the vibration due to drive signals being out-of-phase with one another can be reduced, one of the drive signals being applied to adjacent segment electrodes simultaneously. Thus, the recording head can be safeguarded against breakage.

Figure 19A:
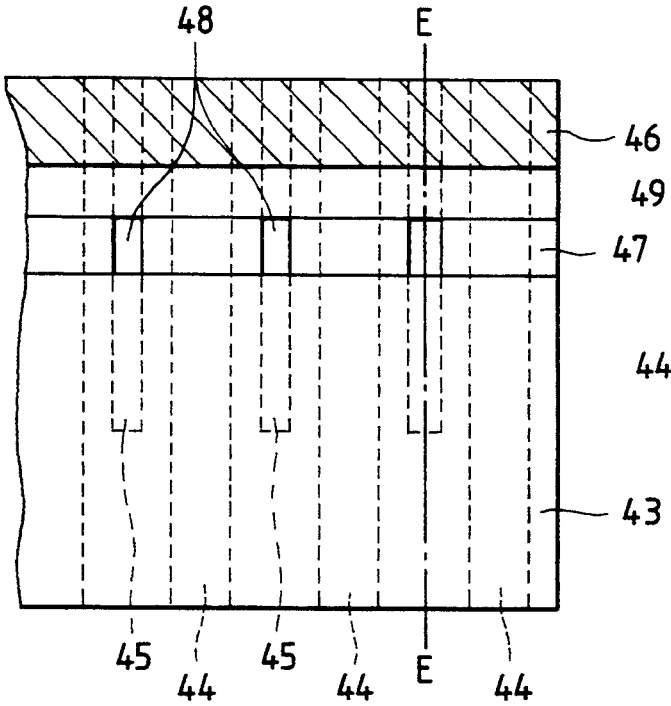
FIGS. 19 (*a*) and (*b*) are diagrams showing an example in which an ink supply path is formed positively utilizing grooves for separating segment electrodes, part (a) of which is a diagram viewed from the side on which a common electrode is formed, while part (b) of which is a diagram showing a section taken along a line E—E.
Figure 19B:
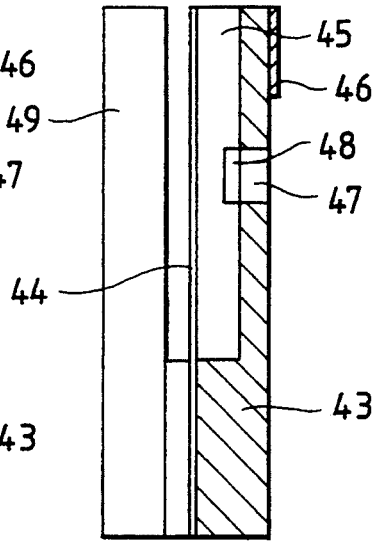

The formation of the grooves between the segment electrodes facilitates ink supply. That is, as shown in FIGS. 19 (*a*) and (*b*), a groove 47 is arranged on a surface opposite to the surface on which grooves 45, each separating segment electrodes 44 arranged on a piezoelectric body substrate 43, are formed, i.e., on a surface on which a common electrode 46 is formed. The groove 47 intersects the grooves 45 for separating the segment electrodes 44 and is deep enough to be connected thereto. As a result, the grooves 45 communicate with the groove 47 at regions 48 where they overlap one upon the other.

A slit plate 49 is arranged on the side of the segment electrodes 44 of the thus constructed piezoelectric body substrate 43, the slit plate serving to form an ink mist jetting outlet. And when ink is supplied from the common electrode 46 side, the ink introduced into the groove 47 flows into the segment electrode 44 side from the region 48 where the groove 45 and the groove 47 intersect and is retained in a gap formed between the slit plate 49 and the segment electrode 44. Upon application of a drive signal to the segment electrode 44 under this condition, an edge-mode vibration is produced at the edge portion of the piezoelectric body substrate 43, hence misting the ink.

According to this embodiment, not only crosstalk caused by the adjacent segment electrodes can be prevented, but also the supply path of the ink to the ink mist jetting outlet can be simplified.

Figure 20:
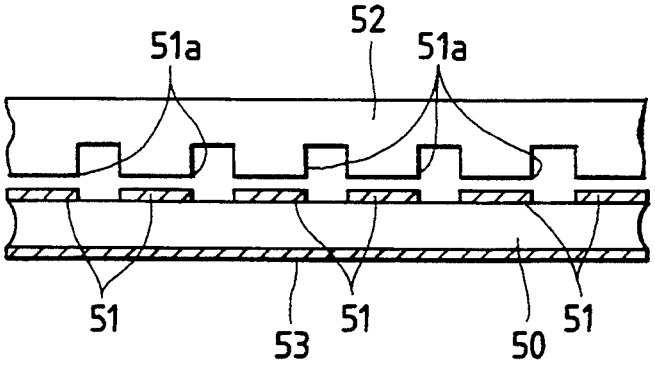
FIG. 20 is a sectional view of an ink jet recording head, which is a sixth embodiment of the invention.

FIG. 20 shows still another embodiment of the invention. In FIG. 20, reference numeral 50 designates a piezoelectric body substrate, on both surfaces of which are segment electrodes 51 and a common electrode 53 formed, respectively. Reference numeral 52 designates an ink mist jetting outlet forming member disposed so as to confront the segment electrodes 51 of the piezoelectric body substrate 50. At its regions confronting the segment electrodes 51 are projections 51*a* arranged to form intervals, each being so long as to produce ink mist, while at its regions confronting the portions between the segment electrodes are recesses arranged to form such gaps as not to produce the ink mist.

According to this embodiment, even leakage of vibration produced by segment electrodes 51 into the portion between the segment electrodes 51 allows no ink mist to be produced, because the gap length here is set to such a value as not to mist the ink.

Figure 21:
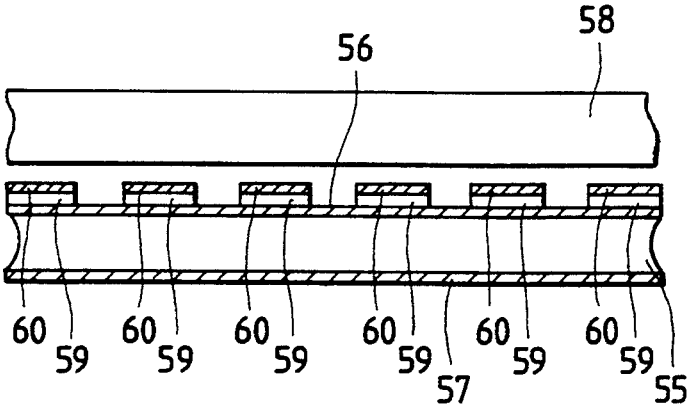
FIG. 21 is a sectional view of an ink jet recording head, which is a seventh embodiment of the invention.

FIG. 21 shows another embodiment of the invention. In FIG. 21, reference numeral 55 designates a piezoelectric body substrate, on both surfaces of which are common electrodes 56, 57 formed so as to cover dot forming regions. Reference numerals 59 designate piezoelectric body substrates, each of which produces an edge-mode vibration. These substrates 59 are disposed so as to position at dot forming regions and maintain electroconductivity with one of the common electrodes 56 of the piezoelectric body substrate 55, while on the other surfaces of the substrates 59 are segment electrodes 60 formed. Reference numeral 58 designates an ink mist jetting outlet forming member disposed so as to maintain an appropriate ink mist forming interval with respect to the segment electrodes 60 of the piezoelectric body substrates 59.

In this embodiment, upon application of a varying D.C. voltage whose power is so low as not to produce the ink mist on the piezoelectric body substrate 55 with the electrode 56 being grounded, the vibration is propagated to the piezoelectric body substrates 59 so as to be imparted to the ink present between the segment electrodes 60 and the ink mist jetting outlet forming member 58. Upon application of a drive signal to the segment electrode 60 with which to form a dot under this condition, the piezoelectric body substrate 59 produces an edge-mode vibration, so that this vibrational energy is superposed on the ink that is receiving the vibrational energy from the piezoelectric body substrate 55. As a result, the ink at this region is misted and splashed toward a recording sheet.

By the way, the piezoelectric body substrates 59 are disposed on the piezoelectric body substrate 55 at a pitch. Since the gap of a dot non-forming region is made larger than the gap of a dot forming region, there is no likelihood that the ink present in the former gap is misted, thereby preventing crosstalk from being caused.

Figure 22:
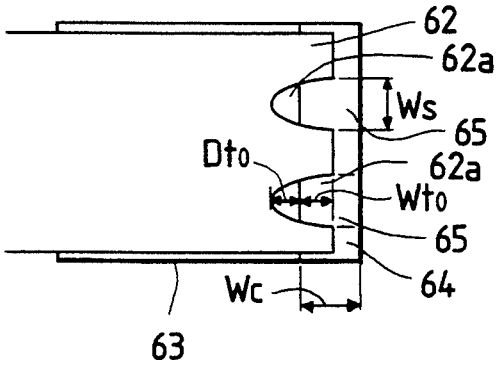
FIGS. 22 and 23 are top views respectively showing exemplary ink mist jetting outlet forming members.

FIG. 22 shows an exemplary ink mist jetting outlet forming member. In FIG. 22, reference numeral 62 designates an ink mist jetting outlet forming member disposed so as to confront a common electrode 64 that is formed at an edge portion of a piezoelectric body substrate 63. On an ink mist forming region, i.e., a region at which the common electrode 64 and segment electrodes 65 intersect, are V-shaped notches 62*a* formed, the notches having a maximum width $W_s$ and a depth of $D_{f0}$.

According to this embodiment, the ink retained in the notches 62*a* by surface tension generates a surface wave while receiving the edge-mode vibration produced by the piezoelectric body substrate 63, thereby misting the ink. The splashing direction of the misted ink is restricted by the notches 62*a* of the ink mist jetting outlet forming member 62 which limit the opening to the air such as windows. Thus, the ink mist is in no other way than being splashed in an direction guided by the notches 62*a*. The presence of the notches 62*a* contributes to reducing the diffusion of the splashing ink mist compared with the case where they are absent, thereby allowing smaller dots to be printed. In addition, even receiving the vibration leaking from adjacent segment electrodes, this embodiment can block splashing of the ink mist produced at dot non-forming regions, thereby allowing a high quality recording to be made.

Figure 23:
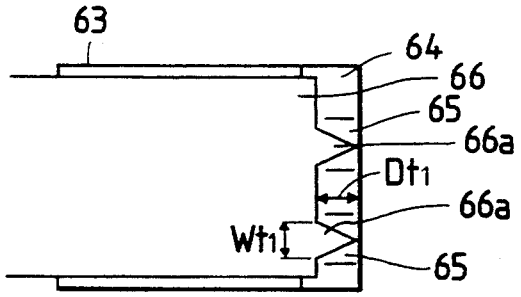

FIG. 23 shows another exemplary ink mist jetting outlet forming member. In FIG. 23, reference numeral 66 designates an ink mist jetting outlet forming member disposed so as to confront the piezoelectric body substrate 63. Triangular projections 66a are formed in a region at an edge portion of the piezoelectric body substrate 63 at which the common electrode 64 and the segment electrodes 65 intersect, each projection having a width of $W_{t1}$ and a depth of $D_{t1}$.

According to this embodiment, the ink present between the ink mist jetting outlet forming member 66 and the piezoelectric body substrate 63 moves only toward the farther region at which the common electrode 64 and the segment electrodes 65 intersect by surface tension relative to the triangular projections 66a. Upon application of a drive signal to the segment electrode 65 with which to form a dot under this condition, an edge-mode vibration produced at this region acts upon the ink retained in the triangular projections 66a, thereby misting the ink. On the other hand, even if the vibration leaks from adjacent segment electrodes, no ink is misted from the triangular projections 66a, because none is present in the triangular projections, thereby totally preventing crosstalk.

Figure 24:
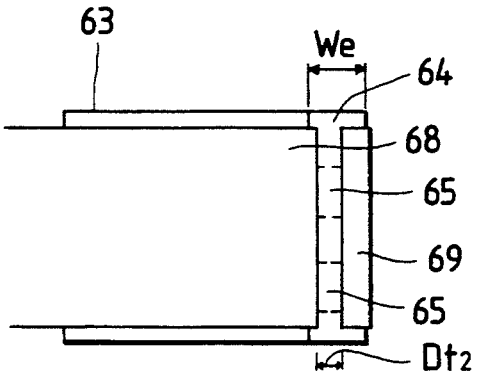
FIG. 24 is a top view showing another exemplary ink mist jetting outlet.

FIG. 24 shows another exemplary ink mist jetting outlet. In FIG. 24, reference numeral 68 designates a first regulating member, one end of which is disposed so as to position at a region at which the common electrode 64 and the segment electrodes 65 formed on the piezoelectric body substrate 63 intersect, and reference numeral 69 designates a second regulating member, one end of which is disposed in a vibrating region $W_c$ while keeping a gap $D_{t2}$ that forms a desired diameter of a dot with respect to the first regulating member 68.

In this embodiment, when ink is supplied to the first regulating member 68 that serves both as an ink supply member, the ink is retained at an edge portion of the first regulating member 68 by capillary action generated between the piezoelectric body substrate 63 and the first regulating member 68. Upon application of a drive signal to the segment electrode with which to form a dot under this condition to thereby produce an edge-mode vibration, the ink retained at the edge of the first regulating member is misted and is about to be splashed outside. However, since the second regulating member 69 is blocking the opening for splashing, part of the produced mist cannot splash. As a result, a dot whose diameter is appropriate for printing can be formed.

Figure 25A:
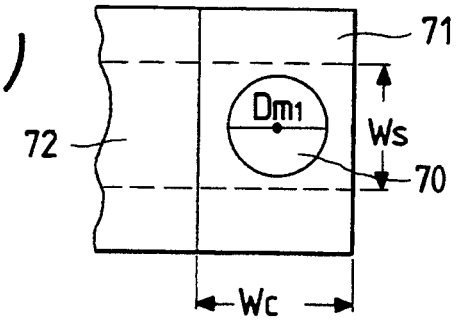
FIGS. 25 (*a*), (*b*), FIGS. 26 (*a*), (*b*), FIGS. 27 (*a*), (*b*), FIGS. 28 (*a*), (*b*) are top views and sectional views respectively showing exemplary electrodes disposed in ink mist forming regions.
Figure 25B:
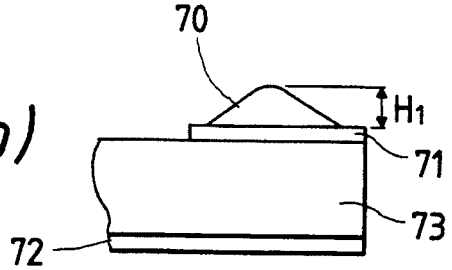

FIGS. 25 (a) and (b) show the structure of a common electrode at an ink mist forming region. In FIGS. 25 (a), (b), reference numeral 70 designates a hornlike projection formed at a vibrating region at which a common electrode 71 and segment electrodes 72 intersect. This projection is formed by thick-film printing using a type of paint which exhibits a high degree of density when dried, such as silver paste whose viscosity is reduced by a solvent.

According to this embodiment, since the edge-mode vibration produced at a piezoelectric body substrate 73 has an extremely short wavelength, its vibrational energy concentrates at the apex of the hornlike projection 70. As a result, the ink retained between the piezoelectric body substrate 73 and an ink mist jetting outlet forming member (not shown) receives a high level of energy from such a limited region as the apex of the hornlike projection 70, causing ink particles, each having an extremely small diameter, to splash at a high velocity in the form of mist. As a result, a dot whose diameter is small can be formed on a recording sheet.

Figure 26A:
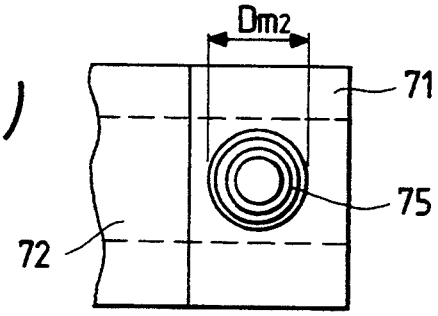
Figure 26B:
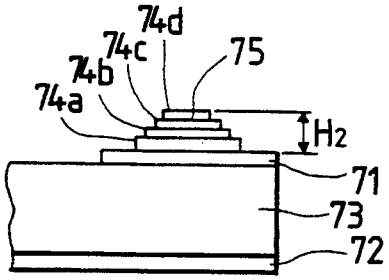

While the hornlike projection 70 is prepared by the silver paste in this embodiment, a hornlike projection 75 having a similar function may be used, the projecting 75 being formed by superposing circular metal films 74a, 74b, 74c, 74d, . . . , whose diameters are gradually reduced, respectively, on upon the other by sputtering, as shown in FIGS. 26 (a) and (b).

Figure 27A:
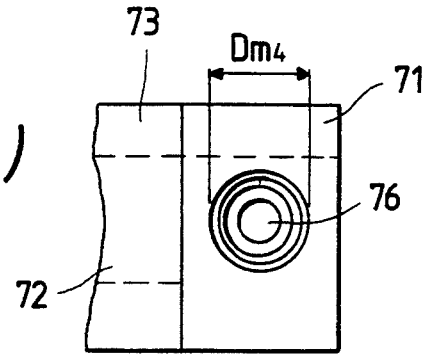
Figure 27B:
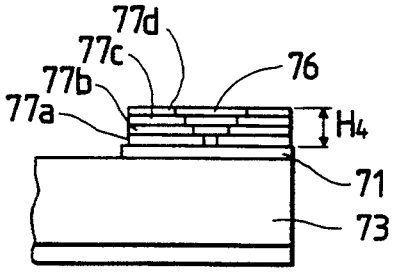
Figure 28A:
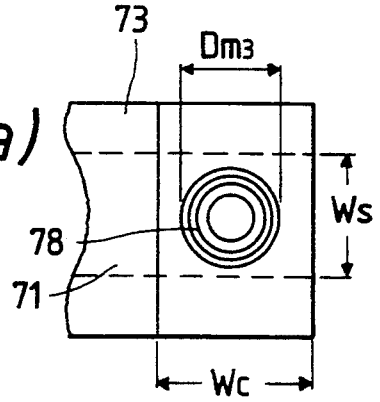
Figure 28B:
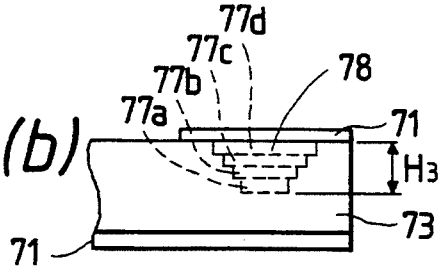

FIG. 27 shows another exemplary common electrode 71 at an ink mist forming region. In FIG. 27, reference numeral 76 designates a recess formed on a surface of the common electrode 71. In this embodiment, the recess is formed by laminating a plurality of layers consisting of annular metal patterns 77a, 77b, 77c, 77d, . . . , whose holes in the center are gradually increased, respectively, by sputtering.

According to this embodiment, the ink transferred from an ink supply member (not shown) to the common electrode 71 enters the recess 76 by surface tension. Upon application of a drive signal to the segment electrode 72 with which to form a dot under this condition, an edge-mode vibration is produced at the piezoelectric body substrate 73, and this vibration is converged toward the center of the recess 76 by the surrounding wall surface of the recess 76, imparting a high degree of vibrational energy to the ink retained there. For this reason, the ink is misted in response to the high level of vibrational energy, splashing outside with its splashing direction being restricted by the wall surface of the recess 76. As a result, a dot whose diameter is small can be printed on a recording sheet.

While the recess is constructed by forming the annular metal patterns on the surface of the common electrode 71 in this embodiment, it goes without saying that a similar function may be obtained by a recess 78 formed on the piezoelectric body substrate 73 while, e.g., etching the recesses 77a, 77b, 77c, 77d, . . . whose radii are gradually reduced, respectively. According to this embodiment, the mass of the vibrating region does not change, thereby allowing the edge-mode vibration to be produced stably.

The structures in which the ink is brought into contact with the common electrode have been described in the embodiments shown in FIGS. 25 (a), (b) to 28 (a), (b). With a structure such that the ink is brought into contact with a segment electrode, it goes without saying that a similar function may be obtained by forming the notches 62a, the pointed portions 66a, the projections 70, or the recesses 76 on the segment electrode by similar techniques.

As is apparent from the foregoing, to produce ink mist, it is necessary to utilize only the vibration with the maximum amplitude produced at the edge portion of the piezoelectric body substrate. When a printer is actually designed, the drive energy must be minimized to thereby simplify the circuitry and prevent the piezoelectric body substrate from being heated uselessly to the extent possible.

Figure 29A:
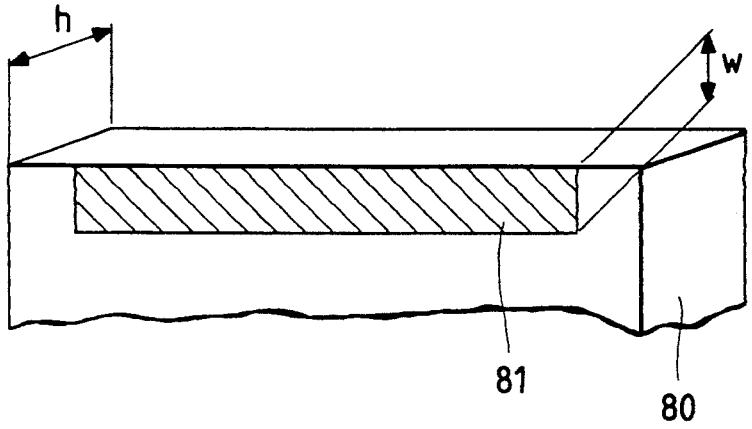
FIGS. 29 (*a*) and (*b*) are diagrams respectively illustrative of the sizes of a common electrode and a segment electrode optimal to an ink jet recording head of the invention.
Figure 29B:
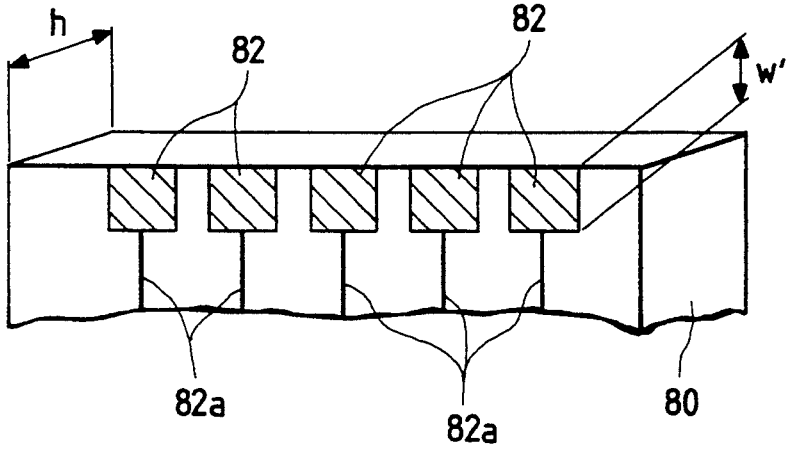

FIGS. 29 (a) and (b) show an exemplary structure of the common electrode and segment electrodes forming a piezoelectric body substrate that has been developed to meet the aforesaid requirements. In FIGS. 29 (a), (b), reference numeral 80 designates a piezoelectric body substrate appropriate for producing an edge-mode vibration, whose thickness h is, e.g., about 200 to 600 μm.

Reference numeral 81 designates a common electrode formed on an edge portion on one of the surfaces of the piezoelectric body substrate 80. Its width W is set to a value one half the thickness h of the piezoelectric body substrate 80.

Reference numerals 82 designate segment electrodes formed on the edge portion of the other surface of the piezoelectric body substrate 80. The segment electrodes confronting the common electrode 81 are formed at a width W' that is, in a similar manner, one half the thickness h of the piezoelectric body substrate 80, and arrayed at such a pitch as to coincide with a single dot length. Ends of lead patterns 82*a* are connected to the segment electrodes 82, respectively, the width of each lead pattern being set to a value extremely smaller than that of the segment electrode.

According to this embodiment, drive signals applied from an external drive circuit act on the segment electrodes 82 via the lead patterns 82*a*, causing an electric field to exert on an area h/2 from the edge portion of the piezoelectric body substrate 80. This causes the piezoelectric body substrate 80 to vibrate in the edge mode only at the region ½ its thickness from its edge, allowing the power applied to the electrodes 81, 82 to be effectively utilized to produce ink mist. Further, it goes without saying that the lead patterns 82*a* are narrow and that the common electrode 81 opposite to them is not present. Thus, there is no likelihood of consuming power uselessly at this region.

Let us now change the respective widths W, W' of the common electrode 81 and the segment electrode 82. As a result, the widths W, W' taking values 30% or less the thickness h of the piezoelectric body substrate 80 can initiate no vibration adequate to produce ink mist at the edge portion of the piezoelectric body substrate 80, while the widths W, W' taking values 70% or more can produce vibrations even at regions not having to do with ink mist production, thereby not only wasting power but also making it likely to increase crosstalk. Therefore, the optimal widths of the common electrode 81 and the segment electrode 82 range from 30 to 70% the thickness h of the piezoelectric body substrate 80 from the standpoint of ink mist producing efficiency, power utilization, and crosstalk prevention.

Figure 30:
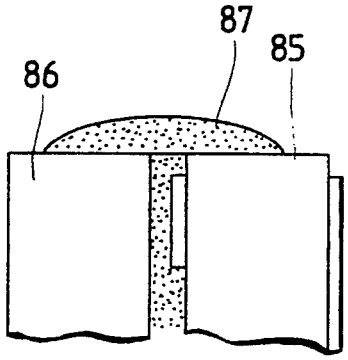
FIG. 30 is a diagram illustrative of a state in which ink is supplied excessively to the ink mist jetting outlet.

By the way, surface tension is a condition that generally exists in a liquid. When ink is supplied excessively to the ink mist jetting outlet due to radical changes in temperature and pressure, the ink clogs a gap in the form of a water drop 87 so as to cover the gap formed between a piezoelectric body substrate 85 and an ink mist jetting outlet forming member 86 as shown in FIG. 30. Since the water drop impedes ink mist production, formation of such water drop must be prevented to ensure stable ink mist production.

Figure 31A:
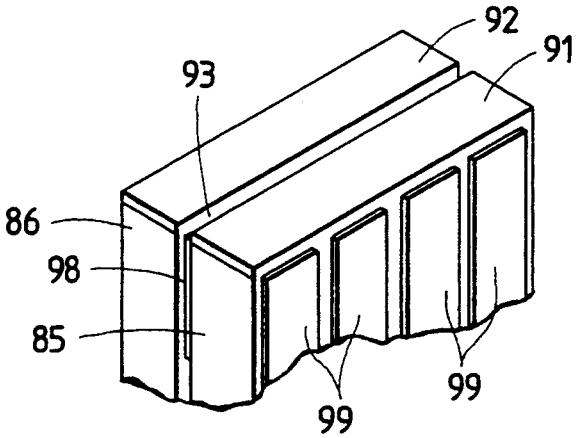
FIGS. 31 (*a*) and (*b*) are diagrams showing an example for preventing production of water drops by the ink supplied excessively to the ink mist jetting outlet, part (b) of which is a diagram showing an operation thereof.
Figure 31B:
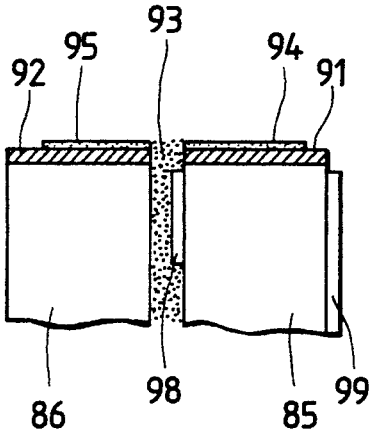

FIG. 31 (*a*) shows an embodiment contrived to prevent the formation of water drops. In FIG. 31 (*a*), reference numerals 91, 92 designate films formed on respective edge portions of the piezoelectric body substrate 85 and the ink supply member 86, both for forming the ink mist jetting outlet. In the case of oil ink, a lipophilic material is selected, while in the case of water-color ink, a hydrophilic material is selected. The films are formed by coating or the like. In the same figure, reference numeral 98 designates common electrodes; and 99 designate segment electrodes, both formed on the piezoelectric body substrate 85.

According to this embodiment, when the ink present at the ink mist jetting outlet 93 that is formed between the piezoelectric body substrate 85 and the ink supply member 86 becomes stagnant due to stoppage of printing, the ink tends to form a water drop over the front end of the jetting outlet 93 by surface tension. However, the lipophilic or hydrophilic films 91, 92 formed on the respective surfaces of the piezoelectric body substrate 85 and the ink supply member 86 causes the ink to be diffused in the formed of layers 94, 95 along the films 91, 92 as shown in FIG. 31 (*b*), thereby allowing no water drop to be formed. Thus, when the printing is resumed, the ink mist is produce stably.

Figure 32:
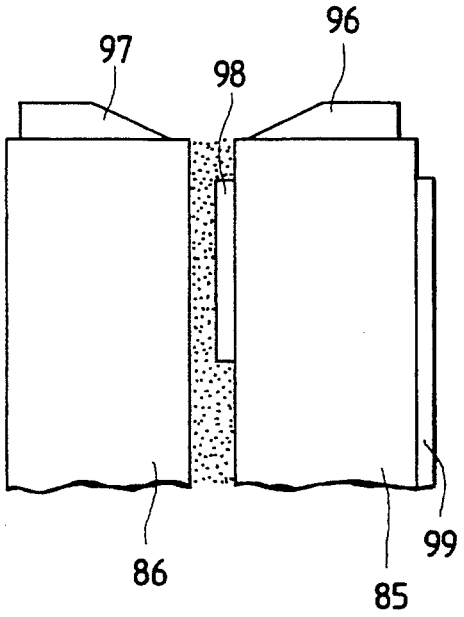
FIG. 32 is a diagram showing another example for preventing production of water drops by the ink supplied excessively to the ink mist jetting outlet.

While the formation of water drops is prevented by increasing wettability while decreasing surface tension at the ink mist jetting outlet in this embodiment, it goes without saying that a similar effect may be obtained by arranging, as shown in FIG. 32, porous bodies 96, 97 capable of absorbing the ink at the respective edge portions of the piezoelectric body substrate 85 and the ink supply member 86 so that the porous bodies 96, 97 absorb the ink that is about to form a water drop over the ink mist jetting outlet 93. According to this embodiment, the ink mist jetting outlet 93, being kept moistened at all times by the solvent of the ink absorbed by the porous bodies 96, 97, is protected from being dried as much as possible, thereby allowing printing to be performed smoothly. While it is both the piezoelectric body substrate 85 and the ink supply member 86 that are coated or provided with the porous bodies in the above embodiments, it goes without saying that it may instead be only one of them that is coated or provided to obtain a similar effect.

Figure 33:
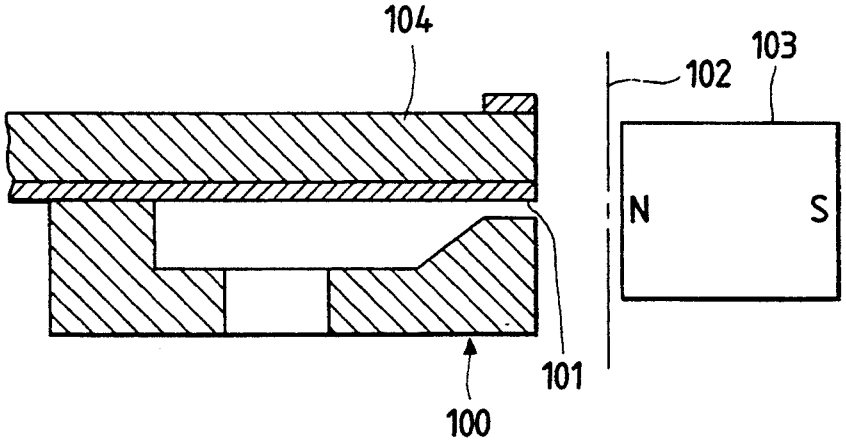
FIG. 33 is a diagram showing a preferred structure of an area around a recording head in the case where magnetic ink is used in the invention.

In the above embodiments the case where the ink that is prepared by dissolving and suspending a pigment into a solvent is used has been described. When magnetic ink in which superfine magnetic particles are suspended in a solvent is used, higher-quality printing can be implemented by setting a recording sheet 102 in front of an ink mist jetting outlet 101 of a recording head 100 and arranging a magnet 103 at the back of the recording sheet 102 as shown in FIG. 33.

That is, the magnetic ink retained at the ink mist jetting outlet 101 receives an edge-mode vibration from a piezoelectric body substrate 104 and the superfine magnetic particles forming the ink are misted together with the solvent and splashed toward the recording sheet 102. The misted superfine magnetic particles reach the recording sheet 102 while accelerated in response to the magnetically attracting force from the magnet 103 in the course of splash. Accordingly, the ink particles, once misted, are no longer diffused, reach and adhere to the recording sheet without fail. Further, since the ink, once misted, splashes toward the recording sheet by the magnetically attracting force, it needs only little splashing energy from the piezoelectric body substrate. Thus, the drive power to be supplied to the piezoelectric body substrate 104 can be reduced, which in turn contributes to low-voltage drive of the drive circuit.

While the ink is accommodated in a space formed between the ink supply member and the piezoelectric body substrate in the above embodiments, it may be so arranged that the ink is retained at the ink retaining member formed, e.g., by a porous body and that the ink is supplied therefrom to the ink misting region.

Figure 34:
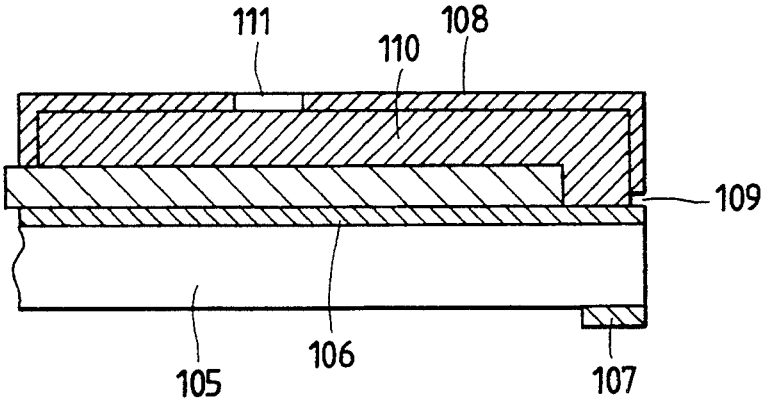

FIG. 34 shows an exemplary recording head using a porous body as an ink retaining member. In FIG. 34, reference numeral 105 designates a piezoelectric body substrate, at the edge portion of which are not only segment electrodes 106 and a common electrode 107, but also an ink mist jetting outlet 109 formed by a case 108. Reference numeral 110 designates a porous body accommodated within the case 108, the porous body serving to absorb and retain ink from an ink supply inlet 111.

In this embodiment, the ink introduced from the ink supply inlet 111 is temporarily absorbed by the porous body 110 and retained by its surface tension. Upon application of a drive signal across the common electrode 107 and the segment electrode 106 under this condition, the piezoelectric body 105 produces an edge-mode vibration. The ink absorbed by the porous body 110 is oozed into the ink mist jetting outlet 109 in response to the vibration, misted at the outlet 109, and splashed outside. When the vibration is no longer exerted on the porous body 110 as the drive signal stops, the ink that is no longer misted and remains at the ink mist jetting outlet 109 is absorbed by the porous body 110 again. As a result, the formation of a water drop over the surface of the ink mist jetting outlet 109 by the ink during stoppage can be prevented, allowing stable printing to be implemented.

Figure 35:
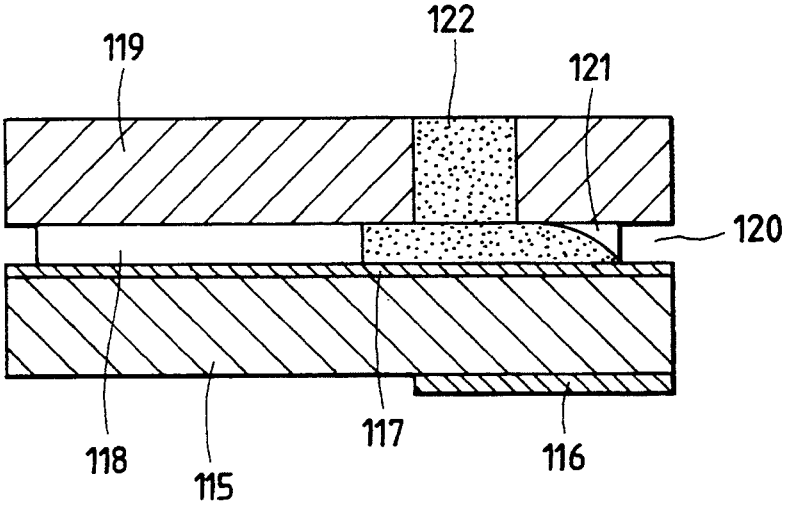

FIG. 35 shows another embodiment of the invention. In FIG. 35, reference numeral 115 designates a piezoelectric body substrate having a common electrode 116 and segment electrodes 117 and being polarized thicknesswise. On one of its surfaces is an ink retaining member 119 provided through a space 118, forming an ink mist jetting outlet 120 at an edge portion of the piezoelectric body 115. Reference numeral 121 designates a wedge member provided either on the piezoelectric body substrate 115 or the ink retaining member 119; it is provided on the ink mist jetting outlet side of the ink retaining member 119 in this embodiment. It is arranged so as to come in resilient contact with the segment electrode 117 at all times to such an extent that the flow of the ink into the ink mist jetting outlet 120 is prevented.

In this embodiment, the ink introduced from an ink supply inlet 122 is retained in a space formed between the ink retaining member 119 and the piezoelectric body substrate 115 with its flow into the ink mist jetting outlet 120 being blocked by the wedge member 121. Upon application of a drive signal to the segment electrode 117 with which to form a dot under this condition, the piezoelectric body substrate 115 produces an edge-mode vibration. The vibration causes a gap to be formed intermittently between the wedge member 121 and the segment electrode 117, and the ink retained in the space between the ink retaining member 119 and the piezoelectric body substrate 115 moves to the ink mist jetting outlet 120 while following this gap. The ink that has reached the gap is misted in response to the edge-mode vibration from the piezoelectric body substrate 115 and splashed toward a recording sheet.

As the substrate 115 no longer vibrates due to stoppage of the application of the drive signal, the wedge member 121 blocks the flow path of the ink to the ink mist jetting outlet 120 while brought into resilient contact with the segment electrode 117. As a result, not only the ink is no longer misted uselessly even with crosstalk from the adjacent segment electrodes, but also the ink solvent is no longer dried nor clogs the outlet because of its being shielded from the air by the wedge member 121.

Figure 36:
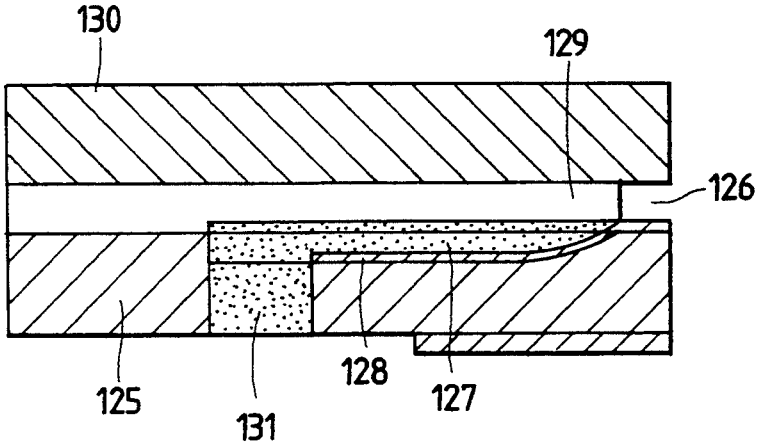

FIG. 36 shows another embodiment using a principle similar to that shown in FIG. 35. In FIG. 36, reference numeral 125 designates a piezoelectric body substrate having a groove 127 that extends to a position immediately before an ink mist jetting outlet 126. Segment electrodes 128 are formed so as to extend to a position appropriate to be connected to an external drive circuit via this groove 127 from the ink mist jetting outlet 126. Reference numeral 129 designates a spacer member which not only has a thickness appropriate for forming the ink mist jetting outlet 126 at an edge portion of the piezoelectric body substrate 125, but also is secured to both the piezoelectric body substrate 125 and an ink mist jetting outlet forming member 130 only at a position on the rear end side (at "left" in FIG. 36) so that the ink mist jetting outlet 126 comes in resilient contact with the front end of the groove 127 of the piezoelectric body substrate 125.

In this embodiment, the ink supplied from an ink supply inlet 131 moves toward the vicinity of the ink mist jetting outlet 126 via the groove 127 that is formed on the piezoelectric body substrate 125. Since the spacer member 129 closes the front end portion of the groove 127 when no drive signal is applied to the piezoelectric body substrate, the ink is not admitted to the ink mist jetting outlet 126. Upon application of a drive signal under this condition, the piezoelectric body substrate 125 produces an edge-mode vibration. As a result, a gap is formed intermittently between the spacer member 129 and the segment electrode 128, causing the ink to follow the gap to move into the ink mist jetting outlet 126. The ink that has reached the ink mist jetting outlet 126 is misted in response to the edge-mode vibration from the piezoelectric body substrate 125 and splashed toward a recording sheet.

When the application of the drive signal is stopped, the spacer member 129 closes the front end portion of the groove 127 formed on the piezoelectric body substrate 125 so that the application of the ink supplied to the ink mist is stopped. As a result, not only the ink is no longer misted uselessly with crosstalk from the adjacent segment electrodes, but also the ink solvent is not clogged.

Figure 37A:
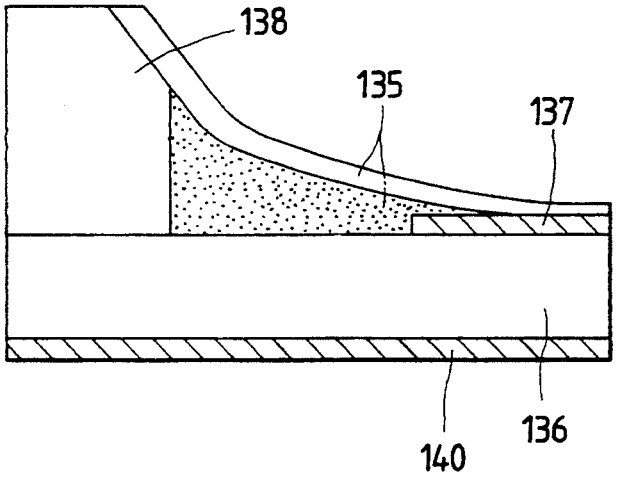
Figure 37B:
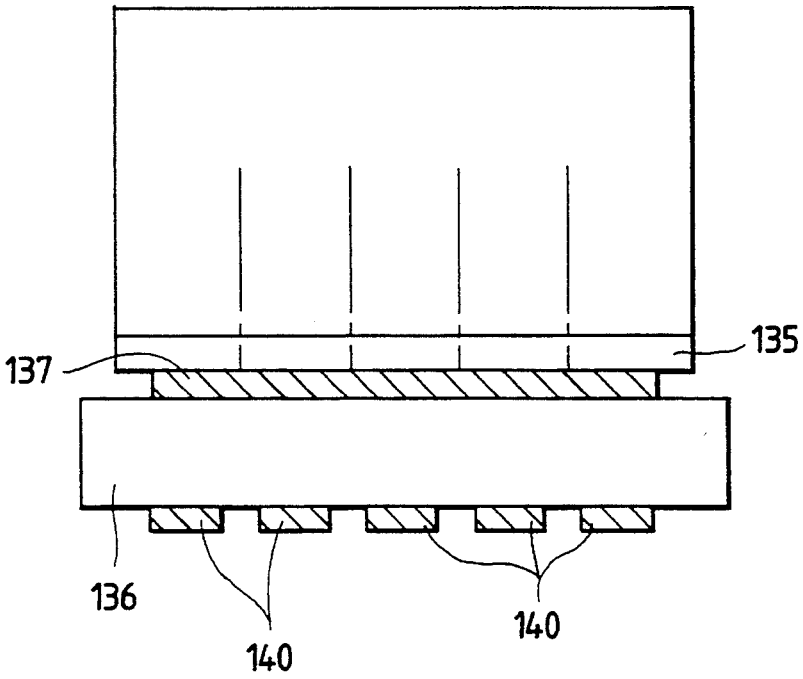

FIGS. 37 (*a*) and (*b*) show another embodiment of the invention. In FIGS. 37 (*a*), (*b*), reference numeral 135 designates an ink mist jetting outlet forming member made of a plate spring member. It is arranged on a piezoelectric body substrate 136 through a fixing member 138 so that one end of the member 135 comes in resilient contact with a common electrode 137 of the piezoelectric body substrate 136. Reference numerals 140 designate segment electrodes disposed on the piezoelectric body substrate 136.

In this embodiment, when ink is loaded to a space 139 formed between the piezoelectric body substrate 136 and the ink mist jetting outlet forming member 135, the ink moves to a front end gap formed between the common electrode 137 and the ink mist jetting outlet forming member 135 by surface tension. Since the ink is shielded from the air by the ink mist jetting outlet forming member 135 under this condition, evaporation of the solvent composing the ink is suppressed, thereby preventing clogging of the gap.

Upon application of a drive voltage to the segment electrode 140 with which to form a dot under this condition, the piezoelectric body substrate 136 produces an edge-mode vibration, forming the gap between the common electrode 137 and the ink mist jetting outlet forming member 135. As a result, the ink flowing into the gap generates a surface wave in response to the edge-mode vibration from the piezoelectric body substrate 136, the ink further being misted and splashed outside.

While a single monolithic plate spring member is provided so as to cover a plurality of dot forming regions in this embodiment, cuts may be provided by the dot forming region as indicated by the one dot chain lines in FIG. 37 (*b*), so that crosstalk from adjacent segment electrodes can be prevented.

Further, while the ink mist jetting outlet forming member is arranged so as to come in contact with the common electrode in this embodiment, it goes without saying that a similar effect may be obtained by causing the ink mist jetting outlet forming member to come in contact with the segment electrodes.

Figure 38:
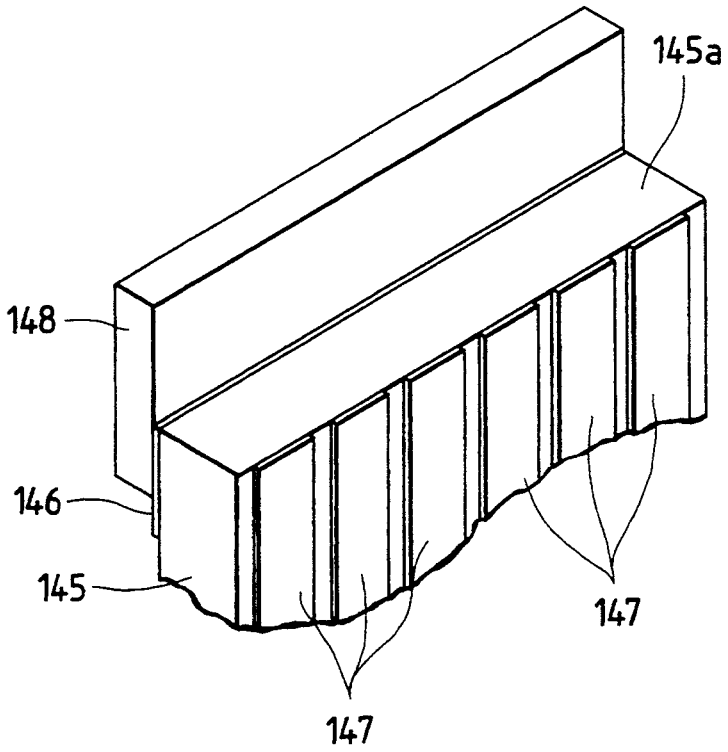
FIG. 38 is a diagram showing an embodiment having a mechanism for amplifying a vibration initiated at an edge portion of the piezoelectric body substrate.
Figure 39:
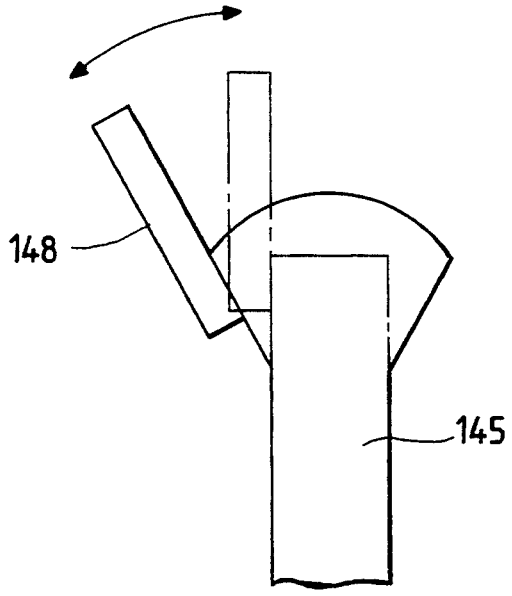
FIG. 39 is a diagram illustrative of an operation of the mechanism shown in FIG. 38.

FIG. 38 shows an exemplary piezoelectric body substrate of the invention. In FIG. 38, reference numeral 145 designates a piezoelectric body substrate for producing an edge-mode vibration. On one of its surfaces is a common electrode 146, while on the other surface are segment electrodes 147 formed. The substrate 145 is also polarized thicknesswise. Reference numeral 148 designates a vibration amplifying plate, which is a thin plate secured to the piezoelectric body substrate 145 by protruding from an edge portion 145*a* of the piezoelectric body substrate 145, the thin plate being extremely thin compared with the thickness of the piezoelectric body substrate 145. In this embodiment, an ink mist jetting outlet forming member is disposed so as to confront the vibration amplifying plate 148 as described before, and a drive signal is applied to the segment electrode 147 with the ink retained by a gap formed between the vibration amplifying plate 148 and the ink mist jetting outlet forming member. As a result, the piezoelectric body substrate 145 similarly produces an edge-mode vibration. Since the vibration produced by the piezoelectric body substrate 145 exhibits the maximum amplitude at the edge, the vibration amplifying plate 148 is subjected to rotational vibration around a single point as shown in FIG. 39, and the amplitude of the front end of the vibration amplifying plate 148 becomes larger than that of the end portion of the piezoelectric body substrate 145. Therefore, the ink present between the ink mist jetting outlet forming member and the vibrating amplifying plate 148 receives a vibration whose amplitude is larger than that produced by the piezoelectric body substrate 145, thereby being misted at a higher efficiency.

Figure 40:
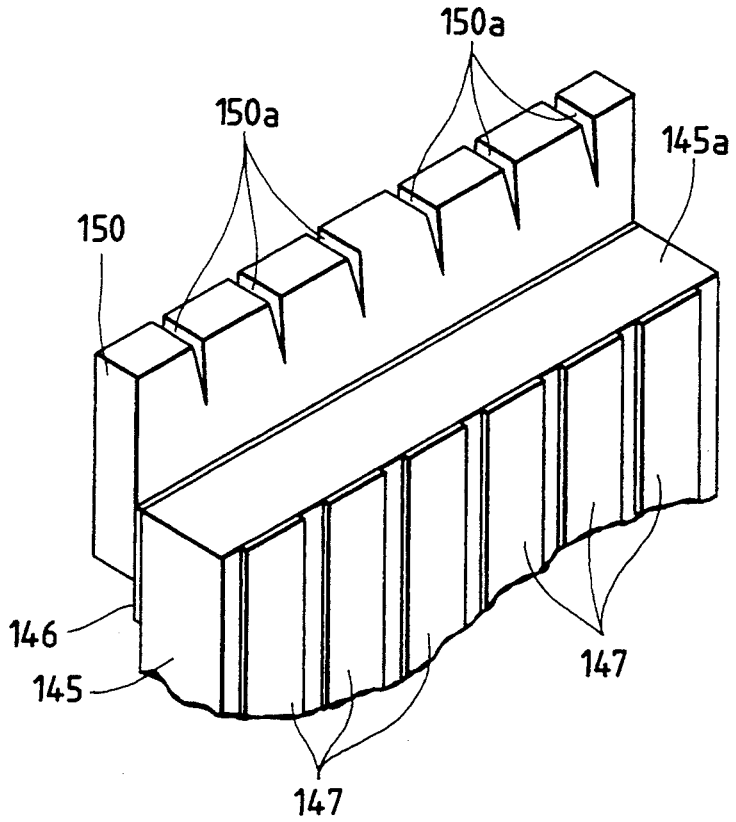
FIGS. 40 and 41 are diagrams respectively showing other exemplary edge portions of the piezoelectric body substrate.

FIG. 40 shows another exemplary vibration amplifying plate. In FIG. 40, reference numeral 150 designates a vibration amplifying plate similarly secured to the edge portion 145*a* of the piezoelectric body substrate 145. On the front end of the plate 150 are V-shaped recesses 150*a* formed at positions confronting the segment electrodes 147.

In this embodiment, the ink mist jetting outlet forming member is similarly disposed so as to confront the vibration amplifying plate 148, and when ink is loaded to a gap formed therebetween, the ink enters the recesses 150*a* by surface tension and is retained there. Upon application of a drive signal to the segment electrode 147 with which to form a dot under this condition, the piezoelectric body substrate 145 produces an edge-mode vibration. Since the vibration causes the front end of the vibration amplifying plate 148 to vibrate at a maximum amplitude, the ink retained at the recesses 150*a* are misted.

According to this embodiment, the ink receiving the vibration is limited only to that retained at the recesses 150*a*, thus preventing the ink mist from being diffused.

Figure 41:
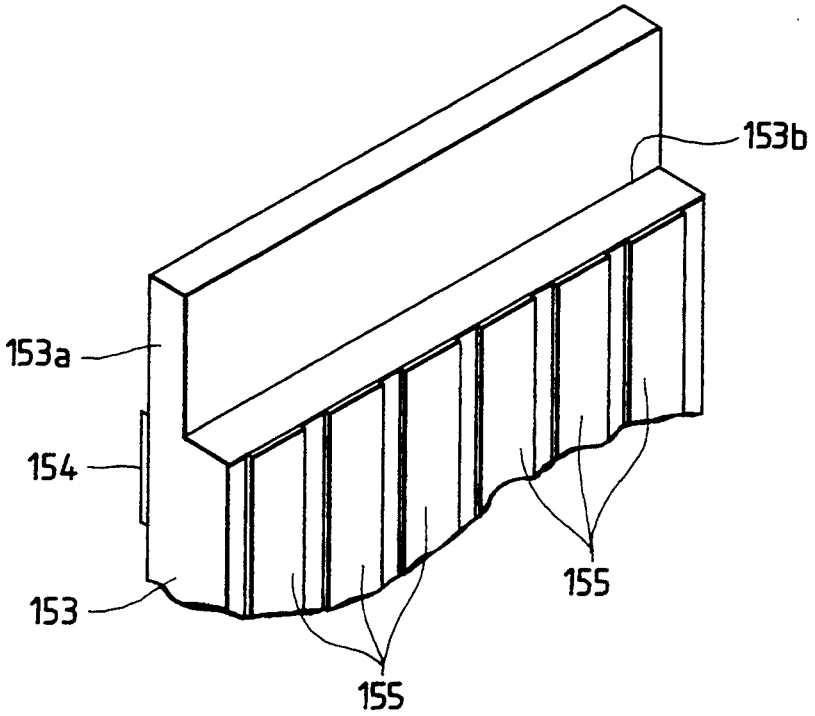

FIG. 41 shows another exemplary vibration amplifying plate. In FIG. 41, reference numeral 153 designates a piezoelectric body substrate, a vibration amplifying section 153*a* is formed on a front end of piezoelectric body substrate 153 by providing a step 153*b* by, e.g., etching. On one surface of the piezoelectric body substrate 153, the surface being closer to the step 153*b*, is a common electrode 154 formed, while on the other surface thereof are segment electrodes 155 formed, so that an edge-mode vibration is induced close to the step 153*b*.

In this embodiment, an ink mist jetting outlet forming member is similarly disposed so as to confront the vibration amplifying section 153*a*, and ink is retained at a gap formed therebetween. Upon application of a drive signal to the segment electrode 155 with which to form a dot under this condition, an edge-mode vibration is produced close to the step 153*b*. Since this vibration is propagated to the vibration amplifying section 153*a* arranged at the front end of the piezoelectric body substrate 153 and has its amplitude amplified, thereby causing the ink to be misted at a higher efficiency.

According to this embodiment, the work of assembling the amplifying plate into the piezoelectric body substrate can be dispensed with, thereby contributing not only to streamlining the fabrication process but also to forming the amplifying plate without substantially increasing the mass of the vibrating region.

Figure 42:
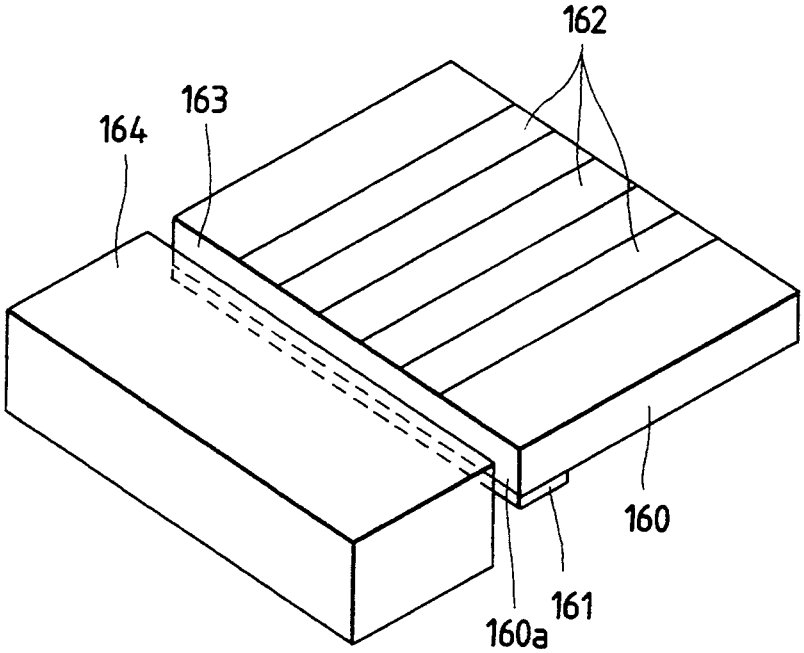
FIGS. 42 and 43 are diagrams respectively showing other examples for forming an ink mist jetting outlet.

While the ink is brought into contact with the electrode and misted by arranging the ink mist jetting outlet forming member so as to confront either the common electrode or the segment electrodes in the above embodiment, a similar effect may be obtained by supplying the ink to the front end portion of the piezoelectric body substrate. That is, in FIG. 42, reference numeral 160 designates a piezoelectric body substrate, on one surface of which is a common electrode 161, while on the other surface of which are segment electrodes 162 so as to intersect the common electrode 161. The substrate 160 is polarized thicknesswise. On its front end portion 160*a* is a gap forming member 164 arranged so that a gap 163 appropriate for producing ink mist is provided.

According to this embodiment, ink is supplied by an ink supply member (not shown) to the gap 163 formed between the front end portion 160*a* of the piezoelectric body substrate 160 and the gap forming member 164 and is retained in the gap 163 by capillary action. Upon application of a drive signal to the segment electrode 162 with which to form a dot under this condition, an edge-mode vibration produced at the front end portion 160*a* of the piezoelectric body substrate 160 is transmitted to the ink, thereby generating a surface wave at the interface between the ink and the air, misting the ink, and splashing the misted ink in a predetermined direction.

Figure 43:
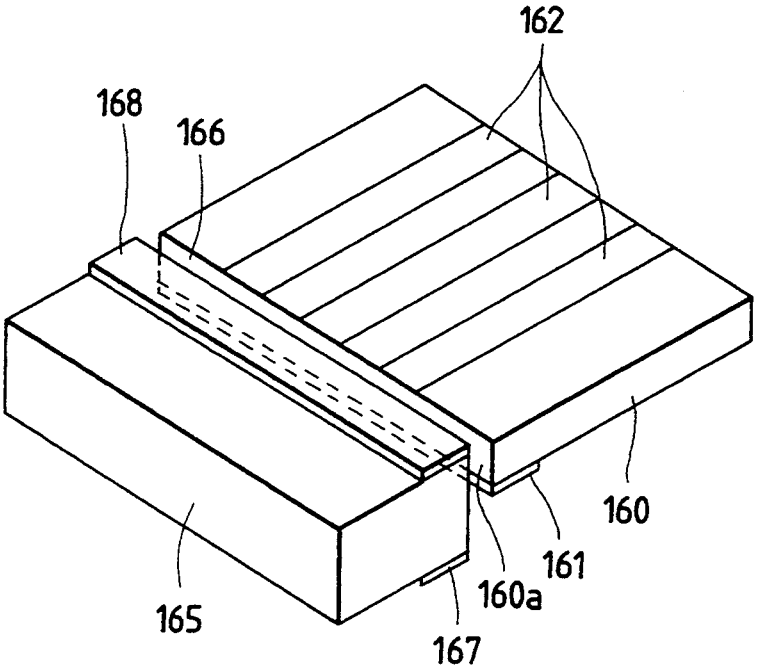

As shown in FIG. 43, in the case of a recording head in which such a vibration as not to mist the ink is applied to the ink, the front end portion 160*a* of the piezoelectric body substrate 160 and a piezoelectric body substrate 165 that can vibrate in an edge mode are disposed so as to form a gap 166 appropriate for producing ink mist, and electrodes 167, 168 are formed on both surfaces of the substrate 165 so as to be on the side of the gap 166. Under this condition, a vibration that is not large enough to mist the ink retained in the gap is similarly applied to the piezoelectric body substrate 165 at all times, whereby upon application of a comparatively small drive signal to the segment electrode 162, the ink can be misted selectively.

Figure 44:
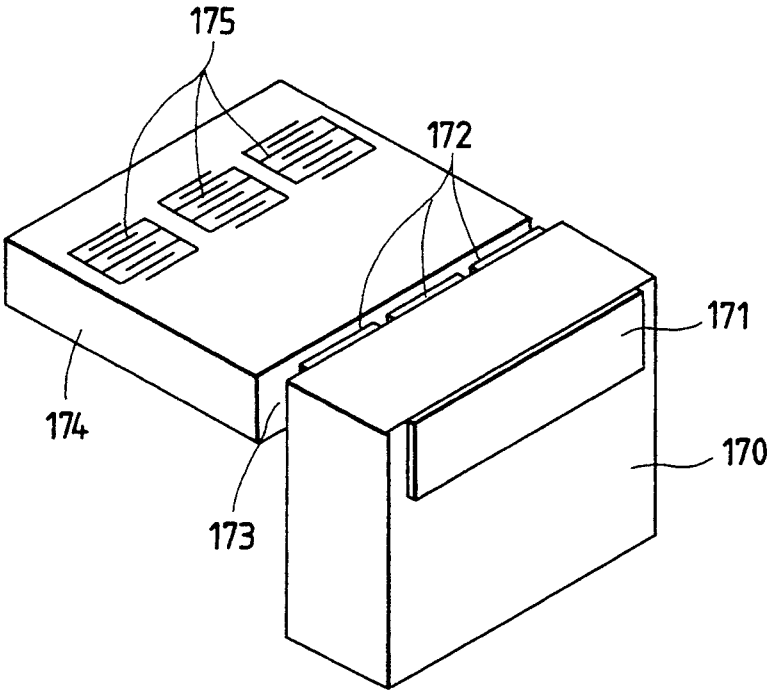
FIG. 44 is a diagram showing an embodiment in which the ink is supplied to the ink mist jetting outlet utilizing a surface wave.

FIG. 44 shows another embodiment of the invention. In FIG. 44, reference numeral 170 designates a piezoelectric body substrate. On a front end portion of one of its surfaces is a common electrode 171 formed, while on the other surface are segment electrodes 172. The substrate 170 is also polarized thicknesswise. In this embodiment, on one of its surfaces, i.e., the surface having the segment electrodes 172 is a piezoelectric body substrate 174 formed. The substrate 174 is arranged adjacent to the front end portion while providing a gap 173 appropriate for producing ink mist therefrom. On a surface of the piezoelectric body substrate 174 are comb-like electrodes 175 arranged so as to confront the segment electrodes 172.

In this embodiment, ink is supplied to the gap 173 from a not shown ink supply member and the ascending level of the ink is limited to the lower end of the gap 173. Under this condition, a varying D.C. signal is applied, the signal having such a frequency that the piezoelectric body substrate 174 produces a surface wave to the comb-like electrode 175 confronting the segment electrode 172 with which to form a dot, and the frequency being, e.g., about 20 MHz. Accordingly, the surface wave moving from the comb-like electrode 175 to the segment electrode 172 is produced, causing the ink at the lower end of the gap 173 to ascend to the surface of the segment electrode 172. Upon application of a drive signal to the segment electrode 172 under this condition, the edge portion of the piezoelectric body substrate 170 produces an edge-mode vibration, and the vibration, acting on the ink ascending along the segment electrode 172, mists the ink. When a dot has been formed and the application of the drive signal to the comb-like electrode 175 and the segment electrode 172 has been stopped, the ink ascending along the segment electrode 172 descends to the lower end of the gap 173. As a result, not only the inconvenience that a water drop is formed at the ink mist jetting outlet as the ink ascends along the gap by capillary action can be prevented, but also the energy of the surface wave imparted from the piezoelectric body substrate 174 to supply the ink can be utilized as energy for misting the ink, thereby contributing to reducing the voltage level of the drive signal that is applied to the segment electrode 172 of the piezoelectric body substrate 170.

Figure 45:
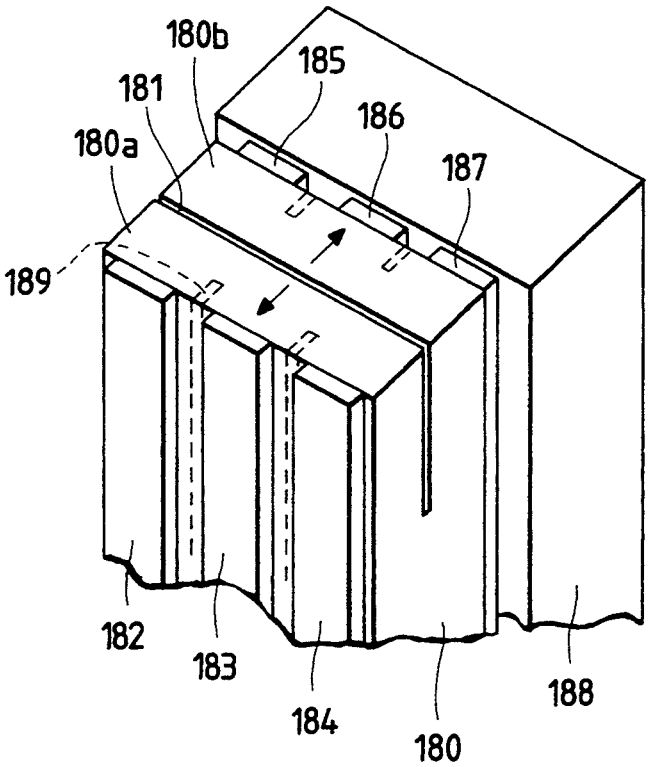
FIG. 45 is a diagram showing an exemplary piezoelectric body substrate suitable for reducing the drive voltage applied to the piezoelectric body substrate.

FIG. 45 shows another embodiment of the invention. In FIG. 45, reference numeral 180 designates a piezoelectric body substrate having a slit formed at the center thicknesswise. The slit has a depth equal to the width of a common electrode that is necessary to initiate an edge-mode vibration from the front end surface of an edge portion of the piezoelectric body substrate 180. A common electrode 181 is formed by embedding a conductor in this slit. The piezoelectric body substrate 180 is divided into two layers 180*a*, 180*b* demarcated by the common electrode 181. These layers 180*a*, 180*b* are polarized so as to oppose each other as indicated by the arrow in FIG. 45. On both surfaces of the piezoelectric body substrate 180 are segment electrodes 182, 183, 184, . . . , and segment electrodes 185, 186, 187, . . . so as to confront one another.

In this embodiment, an ink mist jetting outlet forming member 188 is disposed on the segment electrodes 185, 186, 187, . . . side so as to confront the piezoelectric body substrate 180 to form a gap appropriate for producing ink mist and retain the ink in this gap. Upon application of a drive signal across the segment electrodes 183, 186 at the dot forming position and the common electrode 181, the layers 180*a*, 180*b* of the piezoelectric body substrate 180 produce an edge-mode vibration as if the electrodes were arranged on both surfaces of a single piezoelectric body substrate because a region interposed between the segment electrode 183 and the common electrode 181 and a region interposed between the segment electrode 186 and the common electrode 181 are subjected to alternate electric fields whose phases are opposite to each other. The thus produced vibration is transmitted to the ink retained in the gap and causes the ink to be misted.

According to this embodiment, since the piezoelectric body substrate 180 receives the electric fields by dividing itself into two portions thicknesswise, the voltage level to be applied to the common electrode 181 and the segment electrodes 182 to 187 can be reduced to ½ to obtain an electric field intensity necessary for producing ink mist. This contributes to implementing an inexpensive drive circuit. By arranging grooves between the adjacent segment electrodes 182 to 187 as indicated by the dotted line 189 in FIG. 45, crosstalk from the adjacent segment electrodes can be reduced, thereby enabling a higher quality printing to be performed.

Figure 46A:
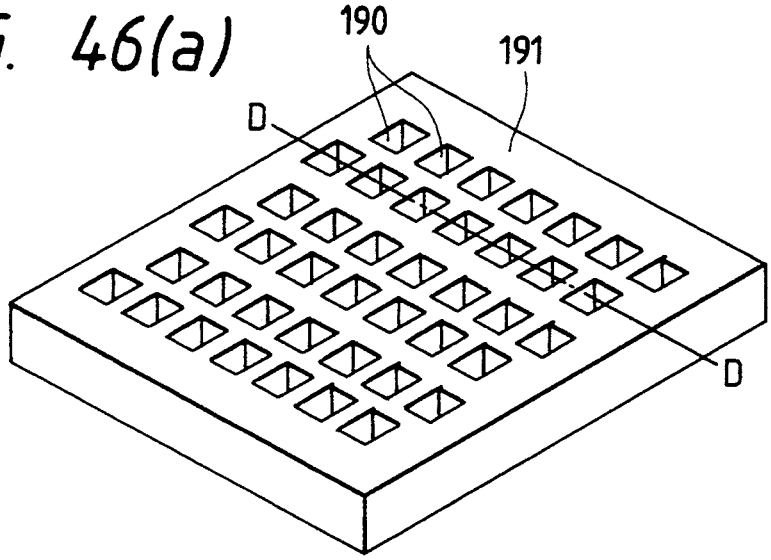
FIGS. 46 (*a*) and (*b*) are diagrams showing exemplary piezoelectric body substrates suitable for use in the ink jet recording head of the invention, part (a) of which shows a general structure thereof and part (b) of which is an enlarged sectional view taken along a line D—D.
Figure 46B:
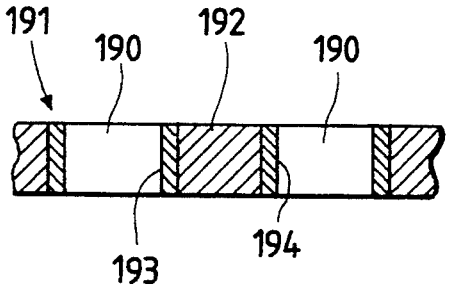

FIGS. 46 (*a*) and (*b*) show another exemplary piezoelectric body substrate of the invention. In FIGS. 46 (*a*), (*b*), reference numerals 190 designate throughholes, each having a rectangular section, bored in a piezoelectric body substrate 191 in correspondence with each dot forming position. The throughholes are arranged at an equal interval in a row and a plurality of rows of throughholes are staggered from one to the other at an appropriate pitch, e.g., by a half the interval. The staggered pitch provides the advantage that the distance between dots to be printed can be reduced. Each of partitions 192 partitioning two adjacent throughholes 190 has its thickness selected so that an edge-mode vibration is induced, and it is polarized thicknesswise. On the surfaces of each partition 192 are electrodes formed as shown in FIG. 46 (*b*) so that each partition 192 can produce an edge-mode vibration.

In this embodiment, when an ink supply member is connected to one of the surfaces of the piezoelectric body substrate 191, e.g., the lower surface, the ink climbs up into the throughholes 190 by surface tension. Upon application of a drive signal to electrodes 193, 194 formed on the partition with which to form a dot under this condition, the surfaces of the partition induce an edge-mode vibration. This vibration is propagated to the ink retained in the throughhole, causing the ink to be misted and splashed outside. This embodiment, producing the ink mist from both surfaces of each partition to which the drive signal is applied, is particularly suitable for use in a printer requiring that large size dots be printed. While this embodiment produces dots by exciting a single partition, it may be two confronting partitions that produce an edge-mode vibration to mist the ink retained between these partitions.

Figure 47:
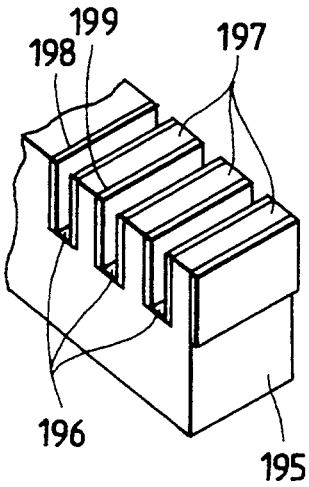
FIGS. 47 and 48 are diagrams respectively showing exemplary assemblies of vibrating elements suitable for use in the recording head of the invention.

FIG. 47 shows another exemplary piezoelectric body substrate suitable for use in an ink jet recording head of the invention. In FIG. 47, reference numeral 195 designates a piezoelectric body block cut into a prism. On one surface thereof are equidistantly arranged grooves 196 to form a plurality of comb-like projections 197. The thickness of each projection 197 is so selected as to produce an edge-mode vibration. Each projection 197 is subjected to a polarization process in the direction of the adjacent recess. On the confronting surfaces of each projection 197 are electrodes 198, 199 formed by, e.g., electroless plating.

When the thus constructed vibrating element block is immersed into a container or the like containing ink, the ink is retained in the grooves. Upon application of a drive signal to the electrodes 198, 199 formed on both surfaces of the projection with which to form a dot, the projection produces an edge-mode vibration, misting the ink retained in the groove and splashing the misted ink outside.

Figure 48:
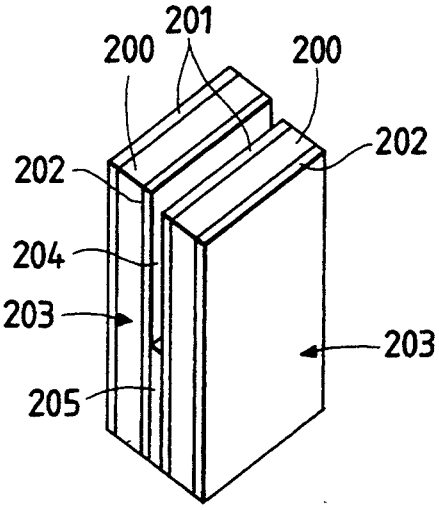

FIG. 48 shows another exemplary vibrating element assembly. In FIG. 48, reference numerals 200 designate piezoelectric body substrates, each being suitable for producing an edge-mode vibration and polarized thicknesswise. On both surfaces of each substrate 200 are electrodes 201, 202 arranged to form a vibrating element 203. These vibrating elements 203 are formed into a vibrating element assembly so that a plurality of vibrating elements 203 are adhesively fixed in a row at one end through spacers 205 interposed therebetween, respectively, each spacer providing a gap 204 appropriate for misting the ink.

In this embodiment, if the ink is retained in the gap 204 in a manner similar to that shown in FIG. 47 and if a drive signal is applied to the electrodes 201, 202, the piezoelectric body substrate 200 produces an edge-mode vibration, thereby misting the ink in the gap 204 and splashing the misted ink outside.

Figure 49A:
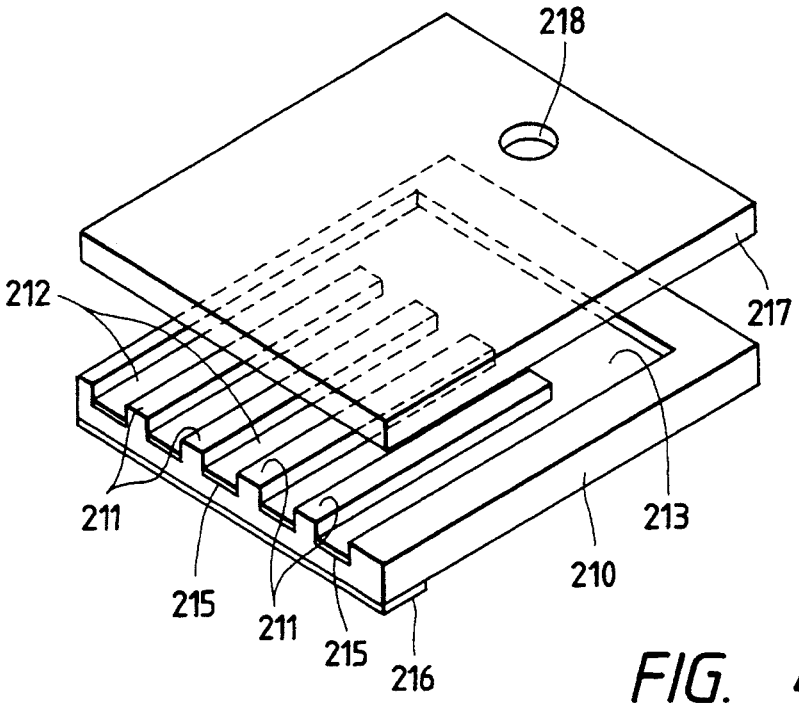
FIGS. 49 (*a*) and (*b*) are diagrams showing other exemplary recording heads of the invention, part (a) of which shows the structure of a piezoelectric body substrate on the side of the ink flow path with a covering body removed therefrom and part (b) of which shows the structure viewed from the side of the ink mist jetting outlet.
Figure 49B:
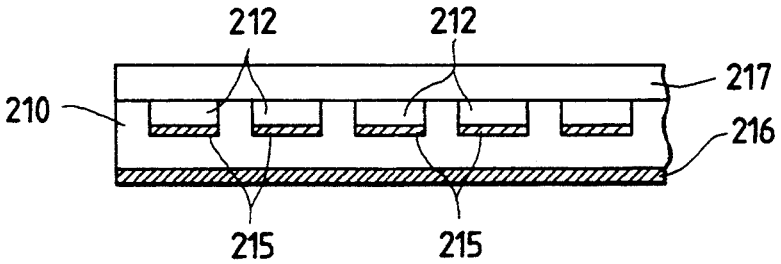

FIGS. 49 (*a*) and (*b*) show another exemplary ink jet recording head of the invention. In FIGS. 49 (*a*), (*b*), reference numeral 210 designates a piezoelectric body substrate that is polarized thicknesswise. On one of its surfaces are a plurality of parallelly extending recesses 212 formed while divided by partitions 211. Each recess 212 has an opening at one end. The thickness of a part of the piezoelectric body substrate having these recesses formed is selected to be a value appropriate to vibrate in an edge mode. On the other surface of the piezoelectric body substrate 210 are recesses for depositing the ink so as to load these recesses 212 with the ink. On the bottoms of these parallelly extending recesses 212 are segment electrodes 215 formed while arranging electroconductive layers 214 by sputtering, electroless plating, or the like. On the other surface of the piezoelectric body substrate 210 is a common electrode extending adjacent to the opening of each recess 212.

When a substrate 217 serving as a covering body has been fixed, e.g., adhesively on the opening side of each recess of the thus constructed piezoelectric body substrate 210, the assembly of the recording head is completed. In FIG. 49 (*a*), reference numeral 218 designates an ink supply inlet.

In this embodiment, as the ink is loaded to a recess 213 from the ink supply inlet 218, the ink moves from a recess 213 to the recesses 212 by surface tension, reaching their opening. Upon application of a drive signal to the segment electrode 215 with which to form a dot under this condition, a part of the piezoelectric body substrate constituting the bottom of the recess 212 vibrates in an edge-mode, misting the ink retained at the recess 212 above and splashing the misted ink outside.

Figure 50:
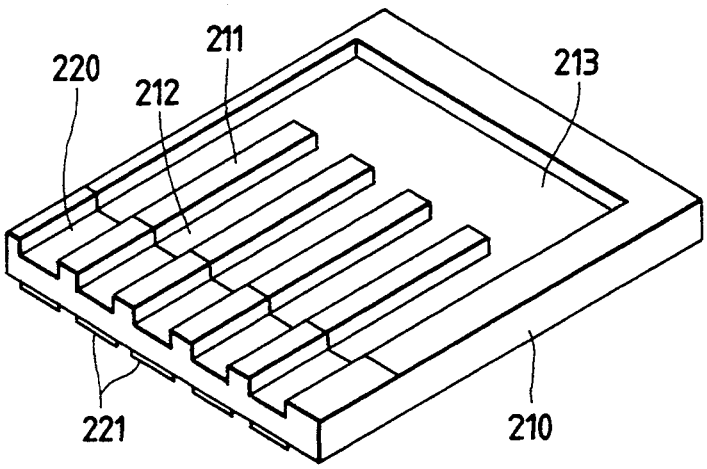
FIG. 50 is a diagram showing an embodiment in which the electrodes shown in FIGS. 49 (*a*) and (*b*) are rearranged.

While the whole body including the recess for depositing the ink is made up of the piezoelectric body substrate in this embodiment, it goes without saying that a similar effect may be obtained by forming only the common electrode and the segment electrodes on the piezoelectric body substrate while forming other portions including the ink depositing recess with a polymer, and by adhesively integrating these two parts. Further, while each segment electrode is formed in each recess 212 of the piezoelectric body substrate 210 in this embodiment, it goes without saying that a similar effect may be obtained by forming a common electrode 220 so as to traverse the recesses 212 and the partitions 211 as shown in FIG. 50, and by arranging segment electrodes 221 on the other surface of the piezoelectric body substrate 210 so as to confront the recesses 212.

Figure 51A:
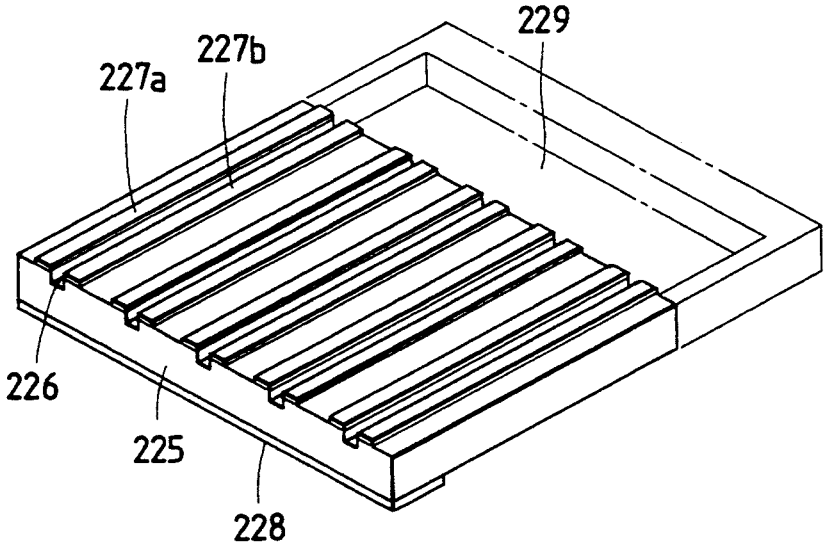
FIGS. 51 (*a*) to (*c*) are diagrams respectively showing piezoelectric body substrates suitable for a recording head of the invention, part (a) of which shows the structure on the side of a segment electrode, parts (b) and (c) respectively show the structures of flow paths formed on the piezoelectric substrates.
Figure 51B:
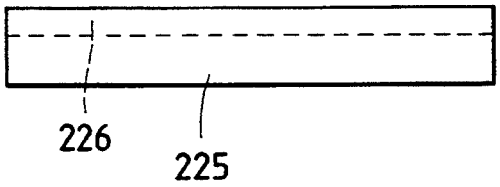
Figure 51C:
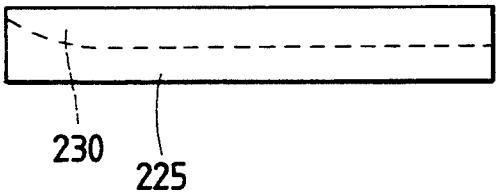

FIGS. 51 (*a*) and (*b*) show another embodiment of the invention. In FIG. 51 (*a*), reference numeral 225 designates a piezoelectric body substrate, on one surface of which are recesses 226 formed so as to correspond to dot forming regions, extending from one end to the other at a single depth as shown in FIG. 51 (*b*). Pairs of segment electrodes 227*a*, 227*b* are formed so as to interpose the respective recesses therebetween. These drive electrodes may also be arranged by first forming a continuous electroconductive pattern that can cover an area to form the recesses, and then forming grooves in the middle thereof using a dicing saw. At one edge portion on the other surface of the piezoelectric body substrate 225 is a common electrode 228 formed. In FIG. 51 (*a*), reference numeral 229 designates a member for forming an ink deposit at the other edge portion of the piezoelectric body substrate 225. This member is formed by, e.g., injection-molding a synthetic resin material and fixed using an adhesive.

In this embodiment, a substrate is fixed on the opening side of the recesses 226 and the ink deposit 229 on the piezoelectric body substrate 225 so that the opening can be sealed, and the ink is loaded to the ink deposit.

Upon application of a drive signal to the segment electrodes 227*a*, 227*b* with which to form a dot under this condition, the region at which the segment electrodes 227*a*, 227*b* are formed produces an edge-mode vibration. The vibration that is produced so as to interpose the recess 226 is propagated to the recess and causes the ink retained in the recess to be misted and splashed outside.

While the recesses 226, each having the same depth, are formed on the piezoelectric body substrate 225 in this embodiment, a boat-like groove whose depth becomes shallower toward the ink mist producing side as shown in FIG. 51 (*c*) may be formed so as to prevent diffusion of the ink mist.

Figure 52:
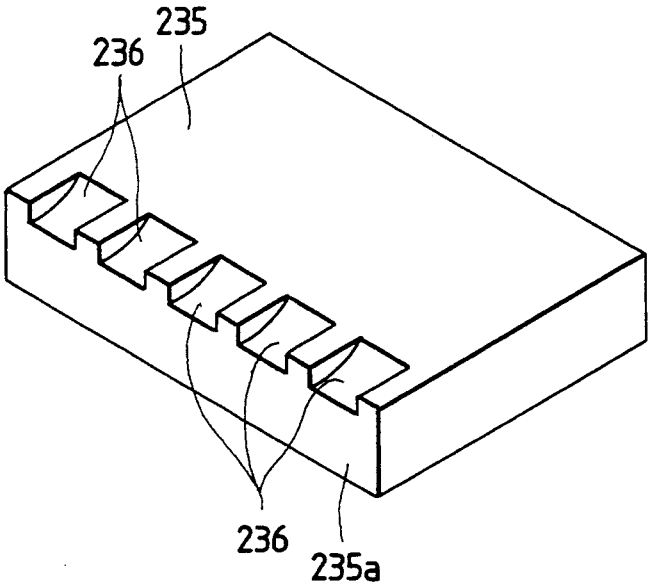
FIG. 52 is a diagram showing the structure of a piezoelectric body substrate suitable for a recording head of the invention.
Figure 53:
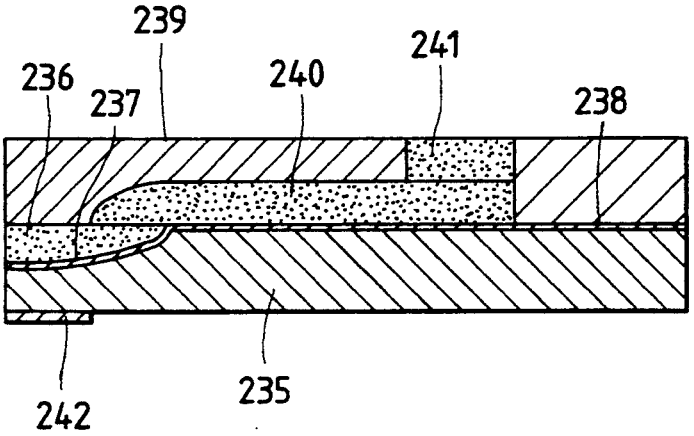
FIG. 53 is a diagram showing a sectional structure of a recording head using the piezoelectric body substrate shown in FIG. 52.

FIG. 52 shows another exemplary piezoelectric body substrate suitable for use in an ink jet recording head of the invention. In FIG. 52, reference numeral 235 designates a piezoelectric body substrate, on one edge portion of which is a front end portion 235*a* that is the deepest portion and on the other edge portion of which are recesses 236 connected to the surface of the substrate 235, each recess being formed so as to correspond a dot forming region. The thickness of the piezoelectric body substrate 235 at its front end is set to a value appropriate to vibrate in an edge-mode. On the bottom of each recess 236 is a segment electrode 237 formed as shown in FIG. 53, which electrode is extended by a lead 238 to a position so as to be properly connected to an external signal source. In FIG. 53, reference numeral 239 designates a substrate for sealing the opening of each recess 236. On its surface that comes in contact with the piezoelectric body substrate 235 is a groove 240 formed, the groove having a length extending from a position confronting a part of the recess 236 to a position appropriate to supply ink so that the ink can be supplied from an ink supply inlet 241 to the recess 236. In FIG. 53, reference numeral 242 designates a common electrode formed so as to confront the recess 236 of the piezoelectric body substrate 235.

The ink supplied from the ink supply inlet 241 in this embodiment flows into the recess 236 of the piezoelectric body substrate 235 via the groove 240 of the substrate 239, and is retained by surface tension in the recess 236. Upon application of a drive signal to the segment electrode 237 with which to form a dot under this condition, the bottom surface of the recess 236 vibrates in an edge mode. This vibration is propagated to the ink retained in the recess 236, misting the ink there and splashing the misted ink outside.

Figure 54A:
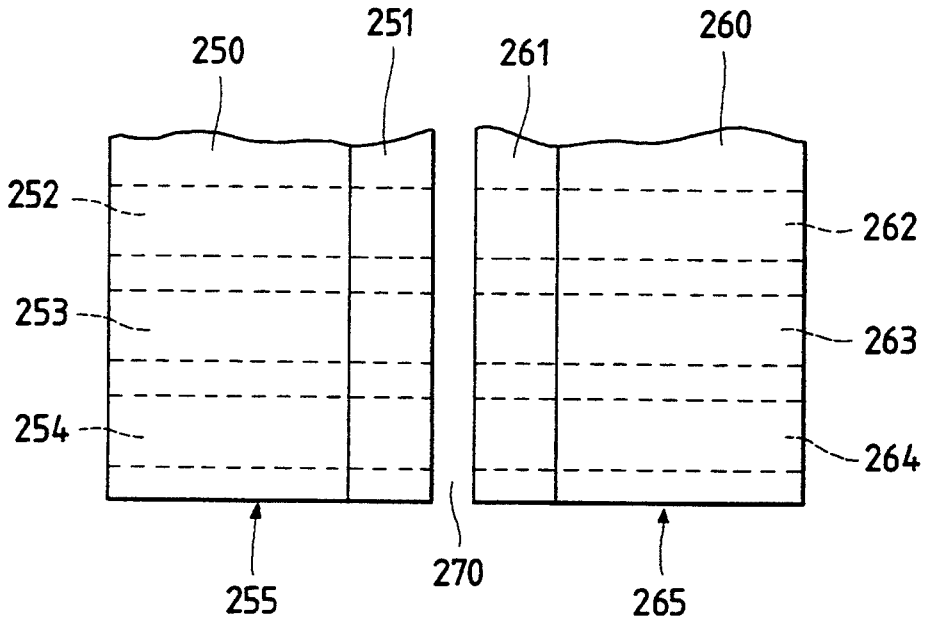
FIGS. 54 (*a*) and (*b*) are diagrams respectively showing an exemplary recording head using a pair of the aforesaid vibrating elements, part (a) of which shows an aspect viewed from the side of the common electrode, and part (b) shows a sectional structure thereof.
Figure 54B:
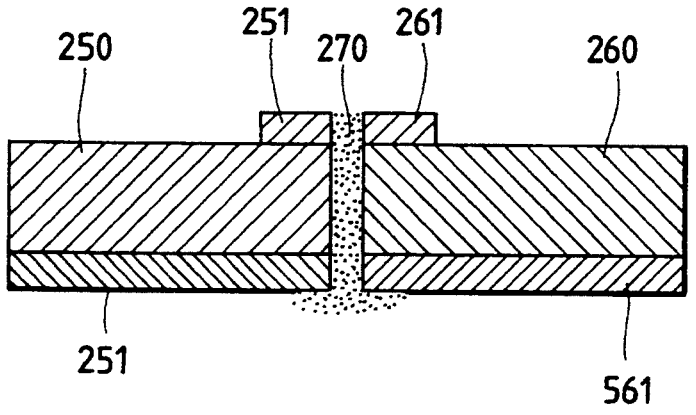

While the case where the piezoelectric body substrate for producing the ink mist is used singly has been described in this embodiment, the substrate may also be used in pair. That is, as shown in FIGS. 54 (*a*) and (*b*), edge-mode vibrating elements 255, 265 are so arranged that on one surfaces of piezoelectric body substrates 250, 260 are common electrodes 251, 261 formed, respectively, while on the other surfaces thereof are segment electrodes 252, 253, 254, . . . and 262, 263, 264, . . . formed, respectively. A recording head is constructed by disposing such edge-mode vibrating elements 255, 265 so that their front end surfaces carrying the common electrodes 251, 261 confront each other to form a gap 270 appropriate for producing ink mist.

When the ink is supplied to one of the surfaces of each vibrating element, e.g., the surface carrying the drive electrode, the ink is retained in the gap 270 by surface tension. Under this condition, drive signals that are 180° -out-of-phase to each other but have the same level are applied to the segment electrodes 252, 253, 254, . . . and 262, 263, 264, . . . of the respective vibrating elements 255, 265. The edge-mode vibrations produced at the front end portions of the confronting vibrating elements 255, 265, being 180°-out-of-phase to each other under this condition, cancel each other out, thereby not misting the ink. On the other hand, in the case where a dot is formed at a special region, e.g., a region where the segment electrodes 253, 263 confront each other, the phase of the drive signal applied to one of these segment electrodes 253, 263, e.g., the segment electrode 253, is inverted. Accordingly, these electrodes 253, 263 receive the drive signals whose phases are the same, and this allows the piezoelectric body substrates 250, 260 at the regions of the electrodes 253, 263 to produce edge-mode structural vibrations of the same phase, thereby misting the ink retained at these regions and splashing the misted ink outside. It goes without saying that the ink retained at regions adjacent to these electrodes 253, 263 and not contributing to forming the dot still receives the vibrations that are 180°-out-of-phase to each other from the piezoelectric body substrates 250, 260, thereby cancelling each vibrational energy out and not misting the ink.

According to this embodiment, the vibrational energy from the two vibrating elements 255, 265 can be given to the ink retained in the gap 270 while superposed at the time the dot is being formed. Thus, the vibrational energy required for each vibrating element for misting the ink may be about half that of the aforesaid constructions with a single vibrating element, thereby contributing to implementing an inexpensive drive signal generating circuit.

While the case where the drive signals of the same level are applied both at the time the dot is being formed and at the time the dot is not being formed has been described in this embodiment, it goes without saying that no drive signals may be applied at the time the dot is not being formed and that drive signals of the same phase are applied to the segment electrodes of both vibrating elements only at the time the dot is being formed. In addition, crosstalk from a segment electrode, which is close to segment electrodes to which no dot forming drive signals are applied and which is not contributing to forming a dot, can be prevented totally by applying a drive signal not only of a level appropriate for cancelling out the vibrations leaking from the driven segment electrodes but also of a phase that is 180°-out-of-phase.

While the drive voltage is applied to the piezoelectric crystal body in correspondence with a dot forming timing in the above embodiment, it goes without saying that a similar effect may be obtained by opening and closing a flow path formed between the piezoelectric crystal body and a slit forming member using a valve mechanism in correspondence with the dot forming timing.

Figure 55A:
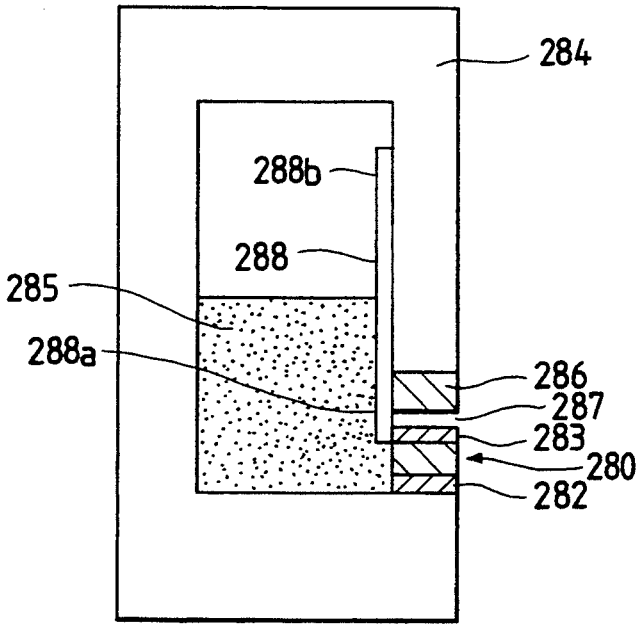
FIGS. 55 (*a*) and (*b*) are diagrams showing structural states of an exemplary recording head using the principle of forming dots of the invention, both at the time no printing is performed and at the time printing is performed.
Figure 55B:
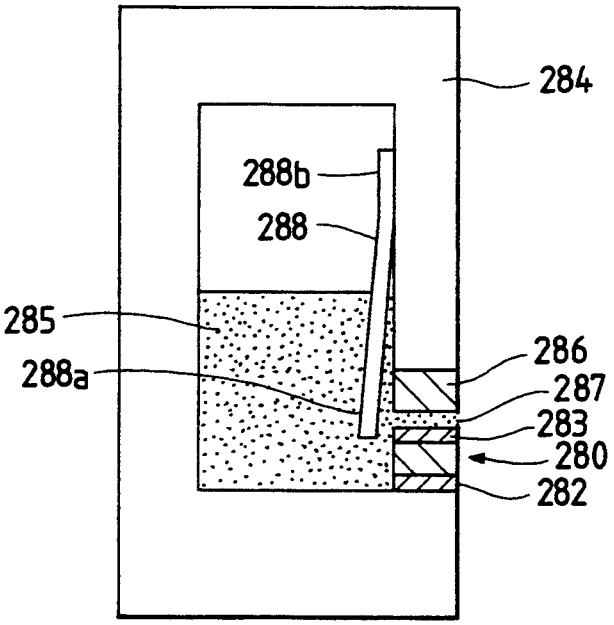

FIGS. 55 (*a*) and (*b*) show another exemplary recording head having the aforesaid valve mechanism. In FIGS. 54 (*a*), (*b*), reference numeral 280 designates a vibrating element in which electrodes 282, 283 are formed on both surfaces of a piezoelectric body substrate 281, and this vibrating element produces an edge-mode vibration. The vibrating element 280 is secured to the opening of an ink tank 284 so that one side thereof confronts a recording sheet and the other side thereof comes in contact with ink 285 in the ink tank 284. Reference numeral 286 designates a slit forming member disposed at an end portion of the opening of the ink tank 284 so as to form a gap 287 appropriate for misting the ink by the vibrating element 280 interposed between the electrodes 283.

Reference numeral 288 designates a bimorph piezoelectric element, one end of which gets curved by the application of a voltage. Its free end 288*a* is in resilient contact with the gap 287 at all times and the other end 288*b* is secured to the tank 284 so that the ink is blocked from entering into the gap 287.

According to this embodiment, the vibrating element 280 receives an alternate voltage whose frequency is appropriate for producing an edge-mode vibration at all times. Since the gap 287 is closed by the end portion 288*a* of the bimorph piezoelectric element 288 when no drive signal is received, the ink is not admitted to the gap 287, thereby producing no ink mist.

On the other hand, upon application of a drive signal to the bimorph piezoelectric element 288 with which to form a dot, the end portion 288*a* of the bimorph piezoelectric element 288 gets curved toward the tank side to cause the gap 287 to communicate with the ink tank 284 (FIG. 55 (*b*)), thereby allowing the ink to be admitted to the gap 287. The ink introduced into the gap 287 is misted and splashed outside in response to the edge-mode vibration from the vibrating element 280 to form a dot on a recording sheet. When the drive signal to the bimorph piezoelectric element 288 is disconnected upon printing the dot of a desired density on the recording sheet, the end portion 288*a* of the bimorph piezoelectric element 288 closes the gap 287 again (FIG. 55 (*a*)). As a result, the supply of the ink is stopped, which stops the ink mist production independently of the presence of vibration from the vibrating element 280.

According to this embodiment, what is required is to apply the drive voltage to the vibrating element 280 at all times and to apply a signal whose voltage level is large enough to drive the bimorph piezoelectric element 288 only when a dot is being formed. Thus, it is no longer required to turn on and off the drive signal to be applied to the vibrating element 280, the drive signal having a high frequency and a comparatively high voltage, thereby not only allowing the drive circuit to be simplified in structure, but also preventing the clogging of the gap by keeping the ink solvent from evaporating while shutting the gap, which is an ink mist jetting outlet, from the ink in the ink tank by the bimorph piezoelectric element when no printing is performed.

The case where the piezoelectric body substrate is made of a PZT ceramic in the above embodiments has been described. If lithium niobate ($LiNbO_3$) or the like whose polarization breakage voltage is high is used, no bias voltage is necessary, thereby contributing to simplifying the drive circuit. It goes without saying that piezoelectric materials made of polymers, such as polyvinylidene fluoride film (PVDF), may be used. In this case, a piezoelectric body substrate having a shape suitable for producing ink mist can be fabricated by injection molding, thereby not only contributing to streamlining the fabrication process, but also improving the reliability of a recording head since such piezoelectric body substrate is highly resistant to brittle fracture.

Figure 56A:
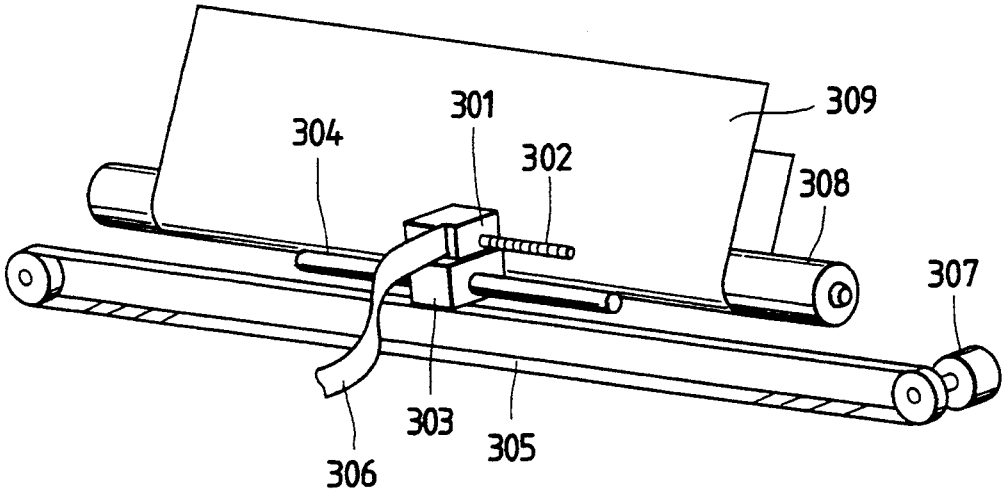
FIGS. 56 (*a*) and (*b*) are a schematic illustration of an ink jet printer including a printing head of the present invention and a sectional view of the ink jet recording head thereof, respectively.
Figure 56B:
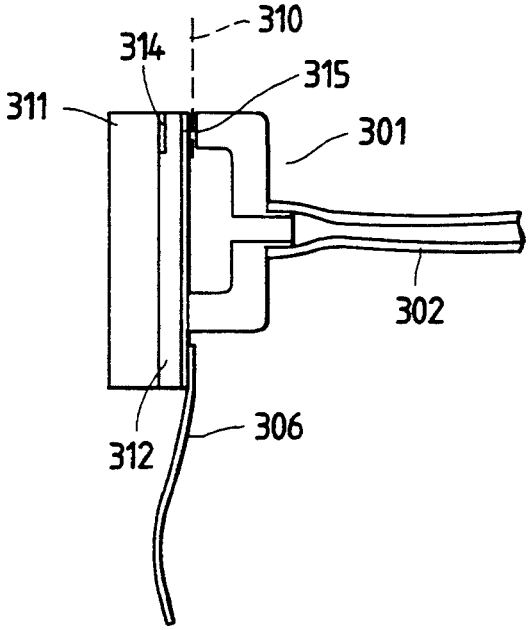

FIG. 56 (*a*) and (*b*) shows one example of an ink jet printer including a ink jet recording head as modified to the ink jet recording head shown in FIG. 1. In FIG. 56 (*a*), a recording paper 309 supported by a platen 308 moves in a longitudinal direction. The ink jet recording head 301 is disposed on a carriage 303 fixed on the carriage conveyance belt 305 which is driven by the carriage conveyance motor 307, and the carriage 303 is slidably engaged with a carriage guide 304. As a result, the ink jet recording head is derived in the horizontal direction.

In FIG. 56 (*b*), the ink jet recording head 301 includes a piezoelectric body substrate 312 having electrodes 314 and 315, which is supported by a support substrate 311, an ink supply member 313 communicated with the ink supply tube 302, a flexible circuit 306 connected to the electrode 315 which is disposed to confront the ink supply member 313, and a ink mist 310 formed between an end portion of the ink supply member 313 and the electrode 315.

What is claimed is:

1. An ink jet recording head comprising:

a piezoelectric body comprising a substrate operable to vibrate in an edge mode, said piezoelectric body being polarized thicknesswise and having at least one edge portion;

first and second electrodes respectively formed on opposite surfaces of said at least one edge portion, corresponding to a dot forming region, of said piezoelectric body, wherein said first and second electrodes drive said substrate in the edge mode when a drive voltage is received by said first and second electrodes to form the dot;

gap forming means forming a gap for producing ink mist at said at least one edge portion of said piezoelectric body, the gap being defined by said edge portion and said gap forming means; and ink supply means for supplying ink to the gap.

2. An ink jet recording head according to claim 1, wherein gap forming means includes a regulating member on an ink mist jetting outlet side thereof, said regulating member serving to limit a range of jetting ink mist.

3. An ink jet recording head according to claim 1, wherein said first electrode comprises a common electrode and said second electrode comprises a segment electrode, said segment electrode receiving a drive signal when selected in accordance with a dot forming operation.

4. An ink jet recording head according to claim 1, wherein both said first and second electrodes are formed as segment electrodes.

5. An ink jet recording head according to any of claims 1 to 3, wherein a width of each of said first and second electrodes is set to 0.3 to 0.7 times the thickness of said piezoelectric body substrate.

6. An ink jet recording head according to claim 5, wherein a recess is formed on one of said first and second electrodes disposed on such a side as to come in contact with said ink, said recess having a bottom area smaller than said dot forming region.

7. An ink jet recording head according to claim 1, wherein a projection is formed on one of said first and second electrodes disposed on such a side as to come in contact with said ink, said projection having a bottom area smaller than said dot forming region.

8. An ink jet recording head according to claim 1, wherein said gap forming means is fixed on a side of one of said first and second electrodes through a spacer, and retains said ink together with a surface of one of said first and second electrodes.

9. An ink jet recording head according to claim 5, wherein said gap forming means serves as said ink supply means.

10. An ink jet recording head according to claim 8, wherein a protrusion is formed on a portion confronting said dot forming region of said gap forming means.

11. An ink jet recording head according to claim 4, wherein said gap forming means is formed so that a gap length of a portion thereof confronting said segment electrode is set to a value appropriate for producing ink mist and that a gap length of a portion thereof confronting a portion between said segment electrode is formed into a comb-like section that is so small as to avoid the generation of ink mist.

12. An ink jet recording head according to claim 1, wherein said gap forming means includes a piezoelectric body substrate, and comb-like electrodes are formed on a surface thereof so that energy of a surface wave is applied to said ink retained in said gap.

13. An ink jet recording head according to claim 1, wherein said gap has a length set to a value less than or equal to 1/30 of a wavelength of an elastic wave propagating through said ink by a vibration produced at said piezoelectric body substrate.

14. An ink jet recording head according to claim 1, wherein the thickness of said piezoelectric body substrate is set to 200 to 600 $\mu$m.

15. An ink jet recording head according to claims 3 or 4, wherein a groove is provided on said piezoelectric body substrate to separate said segment electrode disposed on at least one surface of said piezoelectric body.

16. An ink jet recording head according to claim 1, wherein a vibration amplifying plate is provided on a front end portion of said piezoelectric body substrate and is brought into contact with said ink retained in a gap formed by said gap forming means, said vibration amplifying plate being formed of a plate member.

17. An ink jet recording head according to claim 16, wherein said vibration amplifying plate is formed by providing a step on said front end portion of said piezoelectric body substrate.

18. An ink jet recording head according to claim 17, wherein a recess for retaining said ink is formed on a front end portion of said vibration amplifying plate so as to correspond to said dot forming region.

19. An ink jet recording head according to claim 1, wherein a porous body is accommodated in a space formed by said ink supply means, and said ink is supplied to said gap after being temporarily retained in said porous body.

20. An ink jet recording head according to claim 1 further comprising: water drop formation preventing means for preventing said ink from forming drops of water provided on at least one of a surface of said piezoelectric body substrate and said gap forming member, both serving as an ink mist jetting outlet.

21. An ink jet recording head according to claim 20, wherein said water drop formation preventing means is made of a hydrophilic layer when a hydrophilic type of ink is used.

22. An ink jet recording head according to claim 20, wherein said water drop formation preventing means is made of a lipophilic layer when a lipophilic type of ink is used.

23. An ink jet recording head according to claim 20, wherein said water drop formation preventing means is made of an ink absorbing porous layer.

24. An ink jet recording head comprising:

a vibrating body including a piezoelectric body substrate and first and second electrodes, said first and second electrodes respectively formed on opposite surfaces of an edge portion of said piezoelectric body substrate, so as to confront a dot forming region, wherein said first and second electrodes drive said substrate in an edge mode when said first and second electrodes receive a drive voltage at a time a dot is being formed;

a gap forming means forming a gap for producing ink mist, said gap forming means being disposed so as to confront said edge portion of said vibrating body, and the gap being defined by said edge portion and said gap forming means; and means for supplying ink to the gap.

25. An ink jet recording head according to claim 24, wherein said gap forming member is made of a piezoelectric vibrating plate.

26. An ink jet recording head according to claim 25, wherein said gap forming means includes said first and second electrodes formed on said piezoelectric body to correspond to said dot forming region, and said gap forming means is disposed to correspond to said dot forming region of said vibrating body.

27. An ink jet recording head comprising:

a piezoelectric body substrate;

first electrodes formed on first and second surfaces of at least one edge portion of said piezoelectric body substrate, so as to confront a dot forming region;

a second electrode formed at a central portion of said piezoelectric body substrate in a direction of thickness thereof;

wherein said piezoelectric body substrate and said first and second electrodes form a vibration element that is polarized with said second electrode as a line of symmetry, and wherein said piezoelectric body substrate vibrates in an edge mode when a voltage is applied to said first and second electrodes; and means for producing ink mist, said means disposed to confront a vibrating region of said vibration element.

28. An ink jet recording head comprising:

a piezoelectric body comprising a substrate operable to vibrate in an edge mode, said piezoelectric body being polarized thicknesswise and having at least one edge portion;

first and second electrodes respectively formed on opposite surfaces of said at least one edge portion, corresponding to a dot forming region, of said piezoelectric body, wherein said first and second electrodes drive said substrate in the edge mode when a drive voltage is received by said first and second electrodes to form an ink dot;

gap forming means forming a gap for producing ink mist at said at least one edge portion of said piezoelectric body, the gap being defined by said edge portion and said gap forming means; and an auxiliary vibrating plate disposed on said at least one edge portion to allow vibration to be transmitted thereby.

29. An ink jet recording head according to claim 28, wherein, said auxiliary vibrating plate is disposed on said piezoelectric body to confront said gap forming means.

30. An ink jet recording head according to claim 28, wherein said auxiliary vibrating plate is disposed on an outer surface of said edge portion of said piezoelectric body.

31. An ink jet recording head comprising:

a vibrating body including a piezoelectric body substrate and having a first groove and first and second electrodes, said first groove being located on a dot forming region in an edge portion of said piezoelectric body substrate, said first and second electrodes being formed respectively on a bottom surface of said first groove and on an outer surface confronting said bottom surface, wherein said piezoelectric body substrate vibrates in an edge mode when a voltage is applied to said first and second electrodes; and a substrate having a second groove formed on one end thereof and communicating with said first groove, said substrate being secured to a surface of said piezoelectric body substrate.

32. An ink jet recording head comprising:

a vibrating body including a piezoelectric body substrate, first and second electrodes and a groove, said first and second electrodes formed, respectively, on opposite surfaces of an edge portion of said piezoelectric body substrate, operable to vibrate in an edge mode, wherein said first and second electrodes drive said piezoelectric body substrate in the edge mode when a drive voltage is received by said first and second electrodes at a time a dot is being formed, and said groove communicating with said edge portion;

a substrate disposed to seal an opening of said groove; and ink supply means for supplying ink to said groove.

33. An ink jet recording head according to claim 32, wherein said groove is formed on said piezoelectric body substrate to position between at least one of said first and second electrodes.

34. An ink jet recording head according to claim 32, wherein said groove is formed to divide each of at least one of said first and second electrodes.

35. An ink jet recording head comprising:

a vibrating body including a piezoelectric body substrate and having a plurality of partition segments defining throughholes in said piezoelectric body substrate, and first and second electrodes, the throughholes provided in at least one row to match a dot forming pitch in a direction of thickness of said piezoelectric body substrate, said first and second electrodes being formed respectively on opposite surfaces of said partition segments for separating the throughholes, and said first and second electrodes driving said piezoelectric body substrate in an edge mode when a drive voltage is received by said first and second electrodes at a time dots are being formed; and means for supplying ink to one end of each of the throughholes.

36. An ink jet recording head comprising:

a vibrating body including a piezoelectric body substrate and electrodes, said electrodes formed on confronting surfaces of a front end portion of said piezoelectric body substrate, operable to vibrate in an edge mode, said piezoelectric body substrate being cut into a comb-like shape so that a plurality of projecting rectangular sections are arranged at a dot forming pitch on said front end portion, wherein said electrodes drive said piezoelectric body substrate in the edge mode when said electrodes receive a drive voltage; and a substrate for sealing other portions than said edge portion; and means for supplying ink to recesses corresponding to said projecting sections.

37. An ink jet recording head comprising:

a vibrating body formed by fixing drive elements together, adjacent ones of said drive elements defining a gap suitable for producing ink mist, each of said drive elements including a piezoelectric body and having electrodes formed on first and second surfaces of an edge portion of said piezoelectric body, and said piezoelectric body having a sectional area suitable for forming a dot and being operable to vibrate in an edge mode in response to a drive voltage applied to said electrodes;

a substrate for sealing other portions than said edge portion; and means for supplying ink to the gap.

38. An ink jet recording head comprising:

two vibrating bodies, each of said bodies including a piezoelectric body substrate and first and second electrodes, said electrodes formed, respectively, on first and second surfaces of an edge portion of said piezoelectric body substrate, operable to vibrate in an edge mode, so as to confront a dot forming region, each of said vibrating bodies being polarized thicknesswise; wherein a gap, defined by said piezoelectric body substrates, for producing ink mist over the entire end surface of each of said vibrating bodies is arranged to confront respective dot forming regions; and a drive signal that is in phase is applied to confronting electrodes at a time a dot is formed, while a drive signal that is 180°-out-of-phase is applied at a time a dot is not formed.

39. An ink jet recording head comprising:

a vibrating body including a piezoelectric body substrate and first and second electrodes, said first and second electrodes respectively formed on opposite surfaces of an edge portion of a piezoelectric body substrate, operable to vibrate in an edge mode, so as to confront a dot forming region, said first and second electrodes drive said piezoelectric body substrate in the edge mode when said electrodes receive a drive voltage at a time a dot is being formed;

means for producing ink mist, said ink mist producing means disposed on said edge portion of said piezoelectric body, and said ink mist producing means and said piezoelectric body defining a gap;

means for supplying ink to the gap; and a valve member that normally closes a flow path between the gap and said ink supply means and opens said flow path between the gap and said ink supply means upon application of the drive voltage.

40. An ink jet recording head according to claim 39, wherein said valve member is made of a bimorph vibrating element.

41. An ink jet printer comprising:

an ink jet recording head including:

a piezoelectric body substrate operable to vibrate in an edge mode, said piezoelectric body polarized thicknesswise and having at least one edge portion;

first and second electrodes respectively formed on opposite surfaces of said at least one edge portion, corresponding to a dot forming region, of said piezoelectric body, wherein said first and second electrodes drive said substrate in the edge mode when said electrodes receive a drive voltage to form a dot;

means for producing ink mist, said ink mist producing means disposed at said at least one edge portion of said piezoelectric body, wherein said ink mist producing means and said piezoelectric body define a gap; and ink supply means for supplying ink to the gap.

42. An ink jet printer comprising:

an ink jet recording head including:

a piezoelectric body comprising a substrate operable to vibrate in an edge mode, said piezoelectric body polarized thicknesswise and having at least one edge portion;

first and second electrodes respectively formed on opposite surfaces of said at least one edge portion, corresponding to a dot forming region, of said piezoelectric body, said first and second electrodes drive said substrate in the edge mode when said electrodes receive a drive voltage to form a dot;

means for producing ink mist, said ink mist producing means disposed at said at least one edge portion of said piezoelectric body, wherein said ink mist producing means and said piezoelectric body define a gap;

ink supply means for supplying ink to the gap;

a flexible circuit substrate connected to one of said first and second electrodes; and carriage means for moving said ink jet recording head in a horizontal direction, said ink jet recording head fixed on said carriage means.

43. An ink jet recording head according to any of claims 1, 24, 28, 31, 32, 35, 36, 38, 39, 41 or 42, wherein said drive voltage comprises one of a sinusoidally varying D.C. voltage and a rectangular wave D.C. voltage.

* * * * *